US007712290B2

(12) United States Patent
Imao

(10) Patent No.: US 7,712,290 B2
(45) Date of Patent: May 11, 2010

(54) CONTAINER PACKAGING APPARATUS

(75) Inventor: Shunichi Imao, Tokyo (JP)

(73) Assignee: Sumco Corporation, Tokyo (JP)

( * ) Notice: Subject to any disclaimer, the term of this patent is extended or adjusted under 35 U.S.C. 154(b) by 967 days.

(21) Appl. No.: 11/426,741

(22) Filed: Jun. 27, 2006

(65) Prior Publication Data

US 2006/0288665 A1 Dec. 28, 2006

(30) Foreign Application Priority Data

Jun. 28, 2005 (JP) ..... 2005-189041
Jun. 26, 2006 (JP) ..... 2006-175862

(51) Int. Cl.
*B65B 51/10* (2006.01)
*B65B 31/06* (2006.01)
*B65B 43/26* (2006.01)

(52) U.S. Cl. ..... 53/512; 53/371.8; 53/434; 53/469; 53/479; 141/65; 141/114; 141/166; 141/314

(58) Field of Classification Search ..... 141/65, 141/114, 165–166, 313–314, 316; 53/405, 53/432, 434, 469, 479, 510, 512, 370.7, 371.8
See application file for complete search history.

(56) References Cited

U.S. PATENT DOCUMENTS 5,056,300 A * 10/1991 Suzuki et al. ..... 53/572
5,265,397 A * 11/1993 DePoint et al. ..... 53/434
5,406,776 A * 4/1995 Cappi et al. ..... 53/510
5,551,213 A * 9/1996 Koelsch et al. ..... 53/434
5,561,964 A * 10/1996 McIntyre et al. ..... 53/75
6,499,274 B1 * 12/2002 McDonald et al. ..... 53/434
6,658,821 B2 * 12/2003 Townsend ..... 53/459
7,290,382 B2 * 11/2007 Imao ..... 53/570
2002/0069618 A1 * 6/2002 Otsuka et al. ..... 53/434
2002/0121073 A1 * 9/2002 McGrane et al. ..... 53/459
2002/0121074 A1 * 9/2002 Townsend ..... 53/459
2002/0157353 A1 * 10/2002 Smithson et al. ..... 53/434
2003/0037510 A1 * 2/2003 McGrane et al. ..... 53/459
2004/0098949 A1 * 5/2004 Huang et al. ..... 53/449

FOREIGN PATENT DOCUMENTS

JP 2002-154505 5/2002

OTHER PUBLICATIONS

English Language Abstract of JP 2002-154505.
U.S. Appl. No. 11/426,665 to Imao, filed Jun. 27, 2006.
U.S. Appl. No. 11/426,665 to Imao, filed Jun. 27, 2006.

* cited by examiner

*Primary Examiner*—Gregory L Huson
*Assistant Examiner*—Nicolas A Arnett
(74) *Attorney, Agent, or Firm*—Greenblum & Bernstein P.L.C.

(57) ABSTRACT

A container packaging apparatus includes a side edge chuck member that positions and holds both side ends of an opening of a packaging bag in place during a deaeration operation, suppressing development of crimps in a sealed area of the packaging bag. A high level of sealing of the packaging bag and thus the packaging of a container case with a resultant high level of quality in a stable manner can be obtained.

2 Claims, 24 Drawing Sheets

CONTAINER PACKAGING APPARATUS

BACKGROUND OF THE INVENTION

1. Field of the Invention

The present invention relates to a container packaging apparatus, and in particular to a container packaging apparatus for packaging a container, for example, a wafer case containing a plurality of semiconductor wafers therein, so as to be packed in a packaging bag, such as a plastic bag.

2. Description of the Related Art

In order to prevent any damage or contamination during being transported, semiconductor wafers, such as silicon wafers, which have been manufactured in a wafer manufacturing plant are typically loaded into a wafer cassette, an intermediate holder, made of synthetic resin, which is in turn packed in a wafer case whose cover can be closed tightly via a gasket (a packing member). The wafer case is further packed firstly in an inner bag made of nylon (the trade name of polyamide fiber) and then in an outer bag made of aluminum, in which the wafer case may be enclosed in respective bags via heat sealing. This provides a packaging structure that can prevent any external fine dust or the like from entering into the wafer case to form a deposit on the wafer surface during the transporting operation.

To carry out manually the packaging procedure as described above, firstly the container is inserted into the packaging bag, and then the packaging bag in its sealing area is set in a heat sealing machine or a pressure sealing machine which may carry out the sealing operation with or without deaeration. Subsequently, an opening region and a rear end portion located opposite to the opening region of the packaging bag are folded manually, and both of the end portions of the packaging bag are fixed securely with tape attached thereon, respectively.

If all of the above steps are carried out manually, it takes a considerably long time to accomplish the packaging procedure and adversely it tends to develop crimps in the sealed area. In addition, when carrying out the packaging process incorporated with the deaeration effective in the bag, the condition after the deaeration varies widely, inhibiting the stable packaging procedure to be accomplished. Further disadvantageously, the process of folding and fixing the end portions of the packaging bag by attaching the tape has also imposed a lot of troubles.

There is one known apparatus to address the above problem, including a container packaging apparatus as disclosed in the cited reference, Patent Document No. 1, for example. The container packaging apparatus disclosed by the cited Patent document No. 1 allows for the packaging procedure to be carried out by the divided steps, where the container packaging apparatus comprises: a packaging bag supply means for supplying a transverse-mounted packaging bag into a predetermined position; a container loader means for supplying a container to be packed into a predetermined position; a container insertion means operable to hold by vacuum chuck an opening region of a packaging bag with the aid of a pair of vertically arranged suction arms so as to open the packaging bag in the site of the opening region by moving each of the pair of suction arms vertically away from each other and subsequently to insert the container into the packaging bag through thus opened opening of the bag; a shaping means operable to deaerate the packaging bag containing the container packed therein by a suction nozzle and subsequently to make a heat-seal for closing the opening by a pair of upper and lower sealing bars; and a packaging bag end portion processing means operable to fold an end portion of the sealed packaging bag and fix the folded end portion of the packaging bag.

According to the cited Patent Document No. 1, in the packaging process for carrying out the steps including, inserting the container into the packaging bag; deaeration and packing of the container; heat sealing in the opening of the packaging bag; folding the end portion of the packaging bag; and attaching the tape (label), the packaging apparatus can make the packages uniform in their quality, even if containers different in size, shape or the like are mixedly transferred through respective steps, so as to facilitate mechanization and automation of respective processes and thereby improve a throughput in the packaging procedure.

[Patent Document No. 1]

Japanese Patent Laid-open Publication No. 2002-154505

However, in the cited Patent Document No. 1, when the packaging bag with a container housed therein is deaerated via suction nozzle, the deaeration operation is typically carried out without any solution to position and hold the both side ends of the opening of the packaging bag in place. The apparatus of the cited Patent Document No. 1 has the following drawbacks in association with this manner of the deaeration.

Specifically, crimps are more apt to appear in the opening region of the packaging bag during the deaeration operation, and the heat sealing operation in the opening region, if subsequently applied as in this condition, would cause a problem in the sealing property of the packaging bag. In addition, owing to the crimps developed in the sealed area, the left and the right triangular ear portions in the front end portion of the packaging bag tend to emerge unevenly in its size and shape Consequently, when each of the triangular ear portions in the front end portion and the rear end portion of the packaging bag is folded and fixed with the tape in both sides with respect to the container, the triangular ear portions formed in the front end side of the packaging bag could not be long enough to be fixed well, inhibiting respective sets of triangular ear portions, each set including one in the front end portion and the other in the rear end portions of the packaging bag, from being fixed together by using a predetermined length of tape, and thus the packaging of the container with a resultant high level of quality and the stability during the procedure could not be obtained.

In the light of the above circumstances, the inventors of the present invention have made an enthusiastic research and realized from their research that if the both side ends of the opening region of the packaging bag are positioned and held in place by a side edge chuck means during the deaeration operation, there would be substantially no crimps developed in the opening region of the packaging bag during its being deaerated. This can help provide the packaging bag with a high level of sealing property and a solution to eliminate the unevenness in size and shape between the left and the right triangular ear portions in the front end portion of the packaging bag resultant from the crimps. The inventors of the present invention have accomplished the invention based on their further finding that respective sets of triangular ear portions, each set including one in the bag front end portion and the other in the bag rear end portion, can be fixed together well securely with the tape on either side surface of the packaging bag, thereby providing the packaging of the container with the resultant high level of quality in the stable manner.

BRIEF SUMMERY OF THE INVENTION

An object of a first invention is to provide a container packaging apparatus, which can suppress the development of crimps in a sealed area of the packaging bag, thereby providing a high level of sealing property of the packaging bag and a packaging of the container with a resultant high level of quality in a stable manner.

Another object of the first invention is to provide a container packaging apparatus, which can provide a solution to eliminate unevenness in size and shape between left and right triangular ear portions in the front and the rear end portions of a packaging bag resultant from migration of the container within the packaging bag during a deaeration operation.

A first invention that has been developed to achieve the objects described above provides a container packaging apparatus comprising: a bag opening means for opening a transversely-mounted packaging bag in its site of an opening region defined exclusively in a tip end portion of the packaging bag; a container insertion means for inserting a container into the packaging bag through an opening that has been actually opened in the packaging bag in its site of the opening region; a bag sealing means having a pair of upper and lower sealing members for sealing the opening; a deaeration means for exhausting air inside the packaging bag through a deaeration nozzle that has been inserted from a space defined between the sealing members into the packaging bag through the opening; and a side edge chuck member for positioning and holding both side ends of the opening during a deaeration operation by the deaeration means.

According to the first invention, since the both side ends of the opening of the packaging bag are positioned and held in place by a side edge chuck means during the deaeration operation, therefore there would be substantially no crimps developed in the opening region of the packaging bag during its being deaerated. This can help provide the packaging bag with a high level of sealing property and a solution to eliminate the unevenness in size and shape between the left and the right triangular ear portions in the front end portion of the packaging bag resultant from the crimps. Further advantageously, respective sets of triangular ear portions, each set including one in the bag front end portion and the other in the bag rear end portion, can be fixed together well securely with the tape on either side surface of the packaging bag. Consequently, it becomes possible to provide the packaging of the container with the resultant high level of quality in the stable manner.

Any type of container may be applicable. For example, a wafer case containing semiconductor wafers therein may be employed.

A container of any material and shape may be applicable so far as the container can be packed well in the packaging bag.

A packaging bag used herein means such a bag that has a rectangular shape in plan view as in a state of the bag having been evacuated of the air inside thereof and that has an opening region defined in only one end portion and is closed in three other end portions.

An end (end portion) of the packaging bag defining the opening region is herein referred to as one end (one end portion), a tip (tip portion) or a front end (front end portion). In addition, another end (end portion) of the packaging bag located opposite to the one end defining the opening region of the packaging bag is herein referred to as the other end (the other end portion) or a rear end (rear end portion). Remaining two ends (end portions) other than the front and the rear ends of the packaging bag are herein referred to as side ends (side end portions). Further, a bag longitudinal direction (direction along the length of the packaging bag) means herein a direction connecting the front end to the rear end (front-rear direction) of the packaging bag. A bag width direction (direction along the width of the packaging bag) means herein a direction connecting one of the side ends and the other of the side ends (left-right direction) of the packaging bag. A top to back direction of the packaging bag means herein a direction along a thickness of the packaging bag. A top surface (top side) of the packaging bag means herein a surface (side) facing up when the evacuated packaging bag is loaded on a horizontal table (floor surface). A back surface (back side) of the packaging bag means herein a surface (side) facing down when the evacuated packaging bag is loaded on a horizontal table (floor surface).

A packaging bag in a transversely-mounted state means herein that in a state where the evacuated packaging bag is mounted on a horizontal table (floor surface).

A packaging bag being opened means herein a course of a gap (space) being formed in an opening plane of the packaging bag. A radial direction from an approximately central location of the opening taken as the center means herein a radial direction extending along a plane that has been defined in the opening in the packaging bag, specifically from an approximately central location of the plane defined in the opening taken as the center.

The material of the packaging bag may employ, for example, a variety of synthetic resins (e.g., polyamide resins, polypropylene, polyethylene), a variety of metals (e.g., aluminum) and the like.

As for the type of packaging bag, the bag may be, for example, a three-side sealed flat bag that is open exclusively in its tip end or a gusseted bag. In case of the gusseted bag to be used, a sheet of packaging bag may be fed by pinch rolls or may be transferred as held by a vacuum chuck.

The bag opening means may be of any configuration so far as it has a structure capable of expanding (actually opening) the site of the opening of the packaging bag. For example, one such configuration may be employed that has a pair of vacuum suction pads, each adapted to hold by vacuum chuck the top or the back side of the packing bag, and a means for moving both of the vacuum pads to come closer to/part away from each other.

The container insertion means may be of any configuration so far as it has a structure capable of inserting the container into the packaging bag. For example, the container insertion means may employ such a configuration, in which the container is supported by a support member and the container, as it being supported, is inserted into the bag through the opening thereof by moving the support member horizontally by means of a push-in mechanism.

The bag sealing means may have its sealing mechanism of any type so far as it has a pair of upper and lower sealing bars and is capable of sealing the opening. For example, the bag sealing means may be of a heat sealing type having a pair of upper and lower sealing bars equipped with electrically-heated wires embedded therein respectively or a pressure sealing type having a pair of upper and lower pressure bars.

Although the length of the sealing member may be the same as the length of the opening region, preferably the former may be a bit longer than the latter with some room for the length available in use.

The material of the sealing member may employ, for example, a variety of metals, a variety of synthetic resins of heat insulating property, and a variety of ceramics.

The deaeration nozzle having low profile may be preferably employed, because the low-profile configuration of the nozzle can facilitate the deaeration operation by inserting the nozzle through a space between the sealing members. The material of the deaeration nozzle may employ, for example, a variety of metals, and a variety of synthetic resins of heat insulating property.

The number of deaeration nozzles to be used may be one or more.

The deaeration means may employ such a device that comprises a nozzle insertion/retraction device (e.g. air cylinder) for inserting or retracting the deaeration nozzle into or out of the opening of the packaging bag, and a vacuum generator.

The deaeration used herein means to exhaust the packaging gag of its internal air by vacuum.

A side edge chuck means may employ any type of chuck mechanism for a side edge of the packaging bag, so far as it is capable of positioning and holding the both side ends of the opening in place. For example, the side edge chuck means may employ a chuck mechanism using an air cylinder or an electric-powered cylinder.

A second invention provides a container packaging apparatus as defined in the first invention, which further comprises a container positioning means for restricting the migration of the container within the packaging bag during a deaeration operation by the deaeration means.

According to the second invention, since the migration of the container within the packaging bag during the deaeration operation can be restricted with the aid of the container positioning means, so a solution can be provided to eliminate the unevenness in size and shape between the left and the right triangular ear portions in the front and the rear end portions of the packaging bag resultant from the migration of the container within the packaging bag during the deaeration operation. Consequently, it becomes possible to provide the packaging of the container with a relatively higher level of quality and a more stable manner over the first invention.

The container positioning means may employ any type of mechanism so far as it is capable of restricting the migration of the container within the packaging bag during the deaeration operation. For example, it may employ an air cylinder or an electric-powered cylinder.

According to the first invention, since the both side ends of the opening of the packaging bag are positioned and held in place by a side edge chuck means during the deaeration operation, therefore the development of crimps in the sealed area of the packaging bag can be suppressed, so that the high level of sealing property of the packaging bag and thus the packaging of the container with the resultant high level of quality in the stable manner can be obtained.

According to the second invention, since the migration of the container within the packaging bag during the deaeration operation can be restricted with the aid of the container positioning means, therefore the solution can be provided to eliminate the unevenness in size and shape between the left and the right triangular ear portions in the front and the rear end portions of the packaging bag resultant from the migration of the container within the packaging bag during the deaeration operation. Consequently, it becomes possible to provide the packaging of the container with a much higher level of quality and the stable manner.

DETAILED DESCRIPTION OF THE PREFERRED EMBODIMENTS

The present invention will now be described with reference to the attached drawings. It is to be noticed herein for clarity of the description that: Y1 direction designates a direction along which a container is inserted into a packaging bag; Y2 direction designates a direction opposite to the direction along which a container is inserted into a packaging bag, X1 direction designates one direction orthogonal to the Y1-Y2 direction in a plane; and X2 direction designates the other direction orthogonal to the Y1-Y2 direction in the plane.

It is to be noticed that a container used herein has employed a wafer case holding therein a plurality of wafer cassettes, or intermediate holders, in each of which a silicon wafer is housed. The wafer case is to be firstly inserted and packed in a packaging bag (an inner bag) and then placed in an outer bag made of aluminum for double packing. It is to be understood that the packing procedure by the outer bag is the same as that provided by the inner bag. Accordingly, the duplicated explanation is herein omitted.

Figure 1:
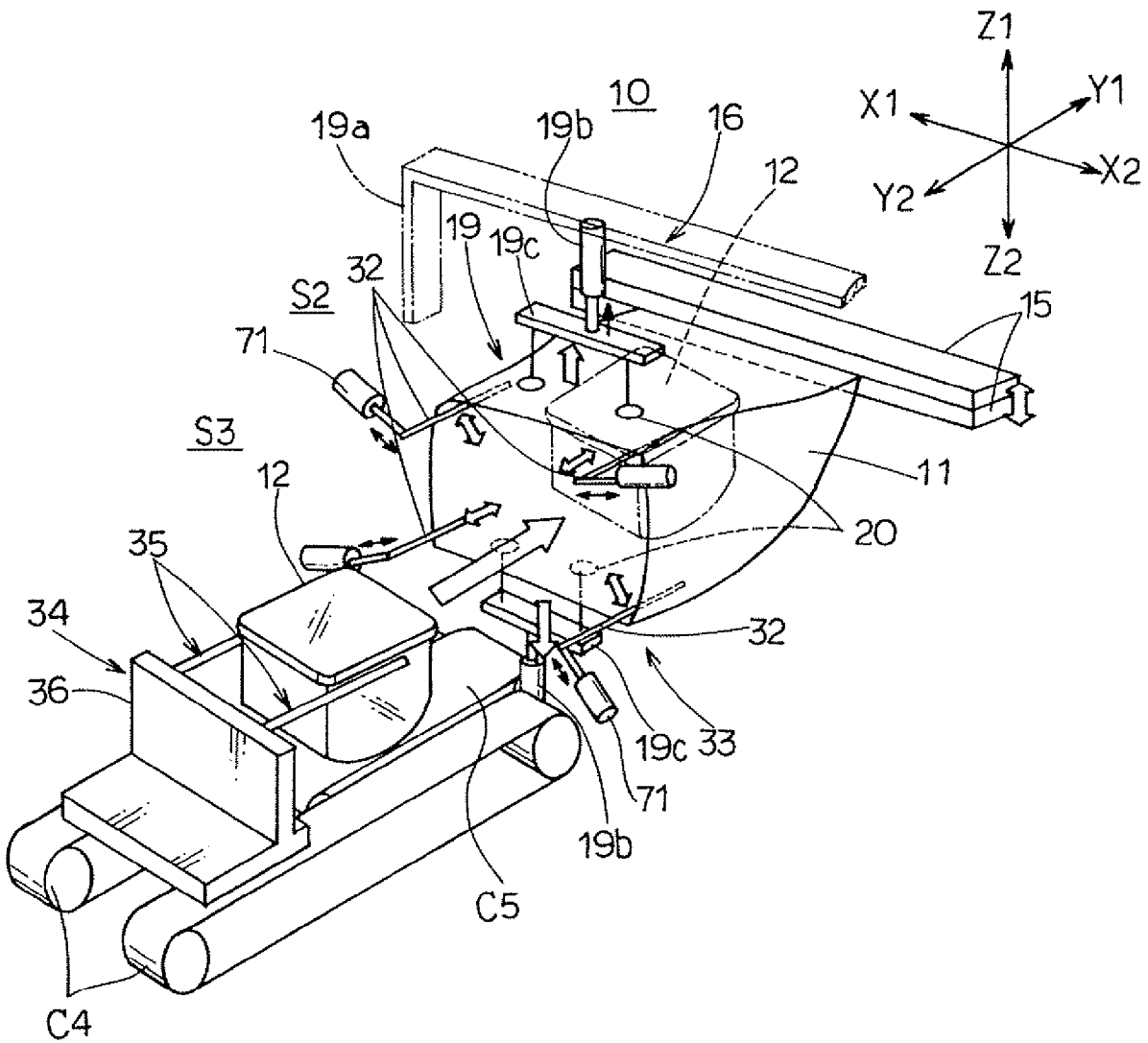
FIG. 1 is a perspective view showing how a container is inserted into a packaging bag in a container packaging apparatus according to an embodiment of the present invention.

With reference to FIG. 1, reference numeral 10 designates a container packaging apparatus according to an embodiment of the present invention, which is operable to open a packaging bag having an opening region defined exclusively in its tip end and sealed in the other three sides and then to insert a wafer case (i.e., a container) 12 that is configured in approximately rectangular parallelepiped into the bag for packing. The packaging bag 11 has employed a flat bag made of nylon (the trade name of polyamide fiber) and sized to accommodate the wafer case 12.

Figure 2:
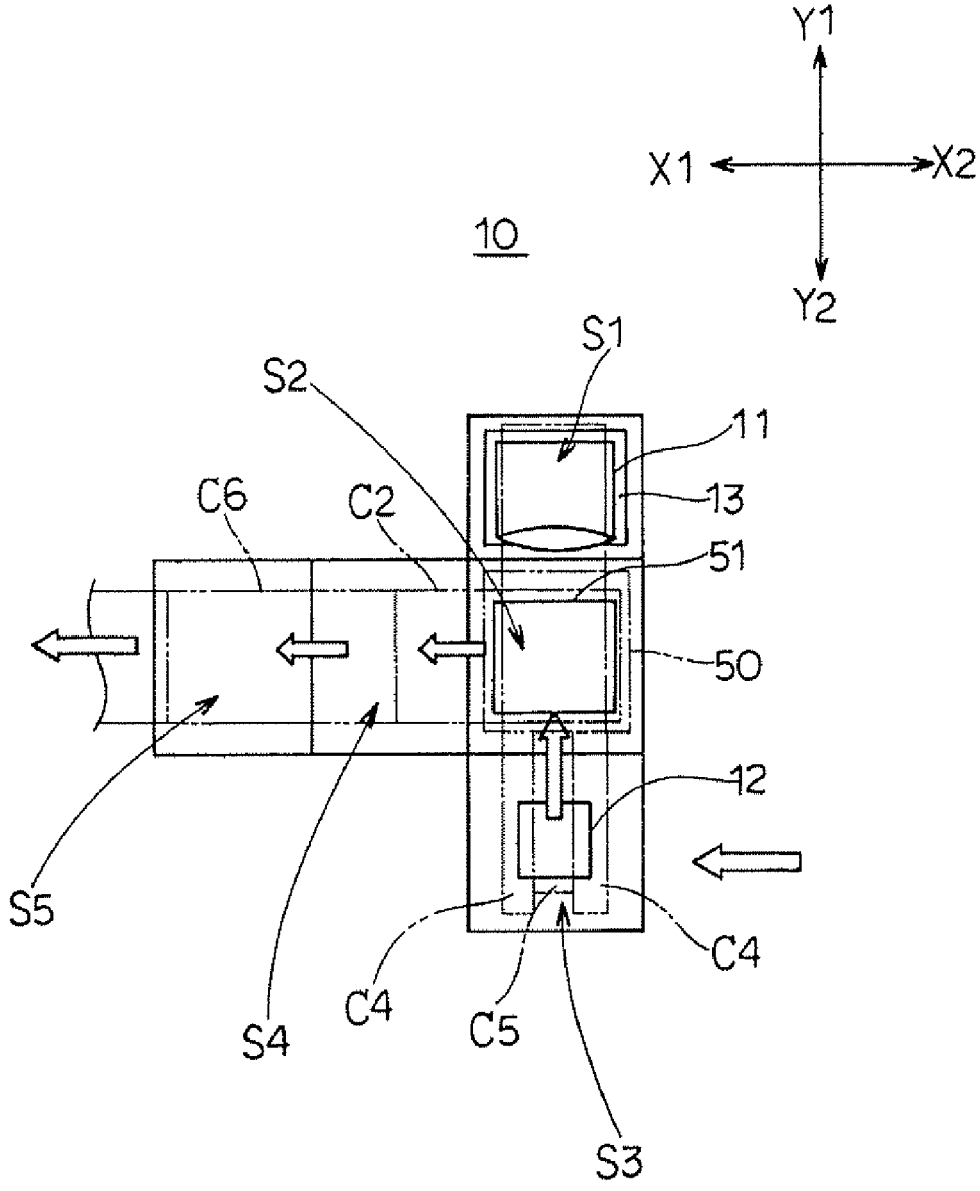
FIG. 2 is a plan view showing an arrangement of respective stages included in a container packaging apparatus according to an embodiment of the present invention.

As shown in FIG. 2, the container packaging apparatus 10 is divided into five stages arranged in the lying-T configuration seen in plan view.

Specifically, the container packaging apparatus 10 comprises: a first stage S1 where a pile of packaging bags 11 is loaded on a bag stock carriage 13 (FIGS. 12 and 13); a second stage S2 disposed in the Y2 side with respect to the stage S1, in which the wafer case 12 is inserted (introduced) into the packaging bag 1; a third stage S3 disposed in the Y2 side with respect to the second stage S2, on which the wafer case 12 is positioned to stand by for the insertion into the bag 11; a fourth stage S4 disposed in the X1 side with respect to the second stage S2, which is operable to carry out a series of operations consisting of deaeration of the packaging bag 11 after the insertion of the case (after the insertion of the container), shaping of a triangular ear portion 11*a* (FIG. 3) to be defined in a rear end portion of the packaging bag 11 and sealing of the opening of the packaging bag 11; and a fifth stage S5 disposed in the X1 side with respect to the fourth stage S4, which is operable to fold the triangular ear portions 11*a* in a front end portion of the packaging bag 11 and to fix the triangular ear portions 11*a* in the front and the rear end portions with tape.

Figure 12:
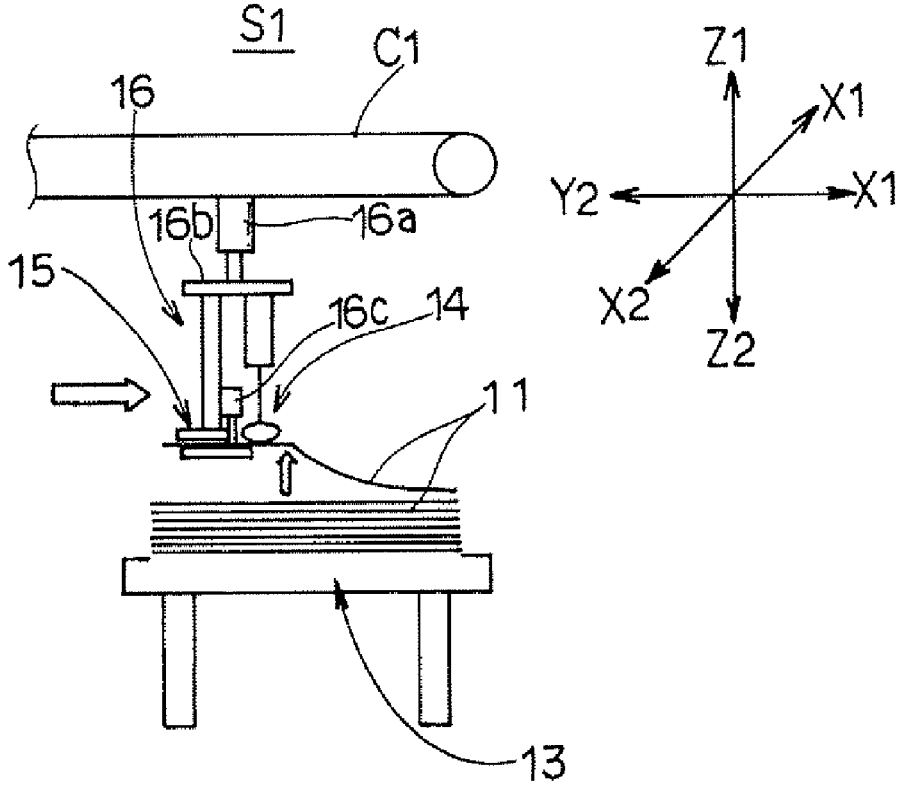
FIG. 12 is a side elevational view showing how a packaging bag is picked up by a container packaging apparatus according to an embodiment of the present invention.

There is a bag stock carriage 13 in the first stage S1, on which a plurality of packaging bags 11 are mounted transversely along the length of the bag taken as the horizontal direction, as shown in FIG. 2 and FIG. 12. In this state, the opening region of each of the packaging bag 11 is facing to the Y2 direction. In addition, the bag stock carriage 13 is arranged such that the opening region of each packaging bag is positioned within the second stage S2 zone.

A plurality of pickup pads 14 (FIG. 12) is disposed in the second stage S2, which is operable to hold by vacuum chuck and then to lift up a region adjacent to the opening of the packaging bag 11, specifically the packaging bag placed on the top of the pile of packaging bags 11 mounted on the bag stock carriage 13. The opening region of the packing bag 11 that has been lifted up by the pickup pads 14 is then chucked (clamped) by a pair of upper and lower bag rear end fixing members 15 of a bag rear end chuck means (i.e., a bag rear end fixing means) 16, and the packaging bag 11 is transferred in its entirety into a zone defined within the second stage S2. Then, the front end portion of the packaging bag 11 is chucked by a bag front end chuck means 17, which will be described later, and then the bag rear end chuck means 16 returns back to an end portion of the second stage S2 defined in the Y1 side, where it chucks the rear end portion of the packaging bag 11 with its bag rear end fixing members 15.

The bag rear end chuck means 16 is disposed in a space above the second stage S2 and has a bag rear end fixing conveyer C1 (FIG. 12) in the form of belt to transfer the respective pickup pads 14 and the pair of bag rear end fixing members 15 between opposite ends of the stage S2, one end defined in the Y1 side and the other end defined in the Y2 side.

The bag rear end fixing conveyer C1 is fixedly attached with an upper end portion of an elevating air cylinder 16*a* with a tip end of a rod thereof directed downward. The tip portion of the rod is fixedly attached with an elevating plate 16*b* extending in the X1-X2 direction and holding the respective pickup pads 14 and the pair of bag rear end fixing members 15, each attached thereto. Both the ends of the elevating plate 16*b* defined in the X1-X2 direction is provided with a pair of bag rear end chucking air cylinders (i.e., a fixing member moving unit) 16*c* operable to move both of the bag rear end fixing members 15 to come closer to/part away from each other by protruding/retracting rods. To come closer/part away from used herein means moving subjects (herein, the bag rear end fixing members 15) closer to/away from each other.

Specifically, in the space above the end of the stage S2 in the Y1 side, the elevating air cylinder 16*a* causes the respective pickup pads 14 and both of the bag rear end fixing members 15 to make an up or down movement simultaneously so as to hold by vacuum chuck and then to lift up the region adjacent to the opening of the packaging bag 11, in particular the packaging bag placed on the top of the pile of packaging bags 11 mounted on the bag stock carriage 13. Immediately after that operation, the rods of the bag rear end chucking air cylinders 16*c* are retracted so as to cause both the bag rear end fixing members 15 to chuck the opening region of the packaging bag 11. As it is, the bag rear end fixing conveyer C1 transfers the elevating plate 16*b* into the zone of second stage S2 in the Y2 side to thereby place the entire packaging bag 11 that has been picked up into the zone within the second stage S2.

Figure 23:
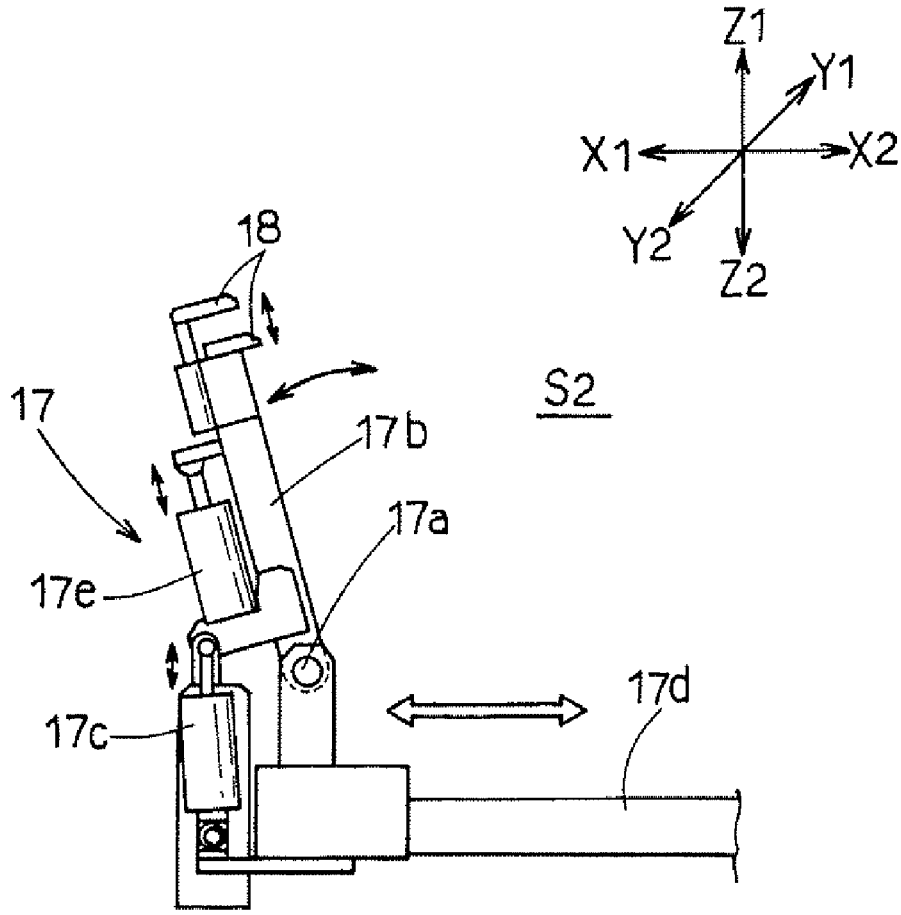
FIG. 23 is an enlarged side elevational view showing a bag tip end chuck means of a container packaging apparatus according to an embodiment of the present invention.

Further, the bag front end chuck means 17 (FIG. 23) is disposed in the end portion of the second stage S2 in its Y2 side, which is operable to releasably fix a tip end portion (end portion defined in the opening side) of the packaging bag 11, in particular at its both side portions in the bag width direction. The bag front end chuck means 17 has: a pair of swing arms 17*b*, each capable of swinging around a horizontal shaft 17*a* as a pivot axis, which are disposed in end portions of the second stage S2 defined in the Y2 side, in particular at the one end in the X1 side and at the other end in the X2 side; a pair of swing motion actuating air cylinders 17*c* disposed in lower end portions (base) of respective swing arms 17*b* for driving the swing arms 17*b* to make the swing motion; a position control conveyer 17*d* in the form of belt, which extends along the X1-X2 direction and causes each of the pair of swing motion actuating air cylinders 17C to come closer to/part away from each other; two pair of upper and lower bag tip side edge chuck members 18 each pair disposed in upper end portion of the swing arm 17*b* for clamping the tip end portion of the packaging bag 11 at one of both sides thereof; and a pair of chucking air cylinders 17*e* operatively disposed on each of the swing arm 17*b* so as to protrude/retract an upwardly headed rod to thereby drive the bag tip side edge chuck members 18 to come closer to/part away from each other.

Specifically, both of the swing motion actuating air cylinders 17*c* are actuated to cause both of the swing arms 17*b* to make a swing motion to thereby position respective corresponding bag tip side edge chuck members 18 in respective sides of the tip end portion of the packaging bag 11. Subsequently, both of the chucking air cylinders 17*e* are actuated to move respective pair of the upper and the lower bag tip side edge chuck members 18 in the direction of approaching to each other to thereby chuck the tip end portion of the packaging bag 11 in its both sides. To control the tension applied to the tip end portion (the opening region) of the packaging bag 11, the position control conveyer 17*d* is actuated to cause each of the swing arms in association with the swing motion actuating air cylinders 17*c* to come closer to/part away from each other.

In addition, a bag opening means 19 is disposed in the second stage S2, which is operable to hold by vacuum chuck the upper and the lower sides of the packaging bag 11 in its opening region, respectively, so as to open the packaging bag 11 in the site of the opening region. The bag opening means 19 is attached to a rectangular stationary frame 19*a* installed upright with its frame width direction in line with the Y1-Y2 direction in the second stage S2 defined in its Y2 side end portion. A pair of upper and lower air cylinders 19*b* is arranged with their rods directed toward each other at intermediate locations in the longitudinal direction of an upper and a lower frame parts of the stationary frame 19*a*. Two pairs of upper and lower opening pads 20 are disposed in tip end portions of respective rods for holding by vacuum the packaging bag 11 in the upper and the lower sides in its opening region.

Specifically, both of the air cylinders 19*b* protrude the rods outward in a synchronized manner to thus cause, with an aid of the elevating plate 19*c*, the two pairs of upper and lower opening pads 20 to hold by vacuum chuck the packaging bag 11 in its upper and the lower sides in the opening region, and then the air cylinders 19*b* actuate the associated rods to be retracted synchronously so as to cause the two pairs of upper and lower opening pads 20 to part away from each other by a certain distance. As a result, the packaging bag 11 is open in the site of the opening region.

Figure 3:
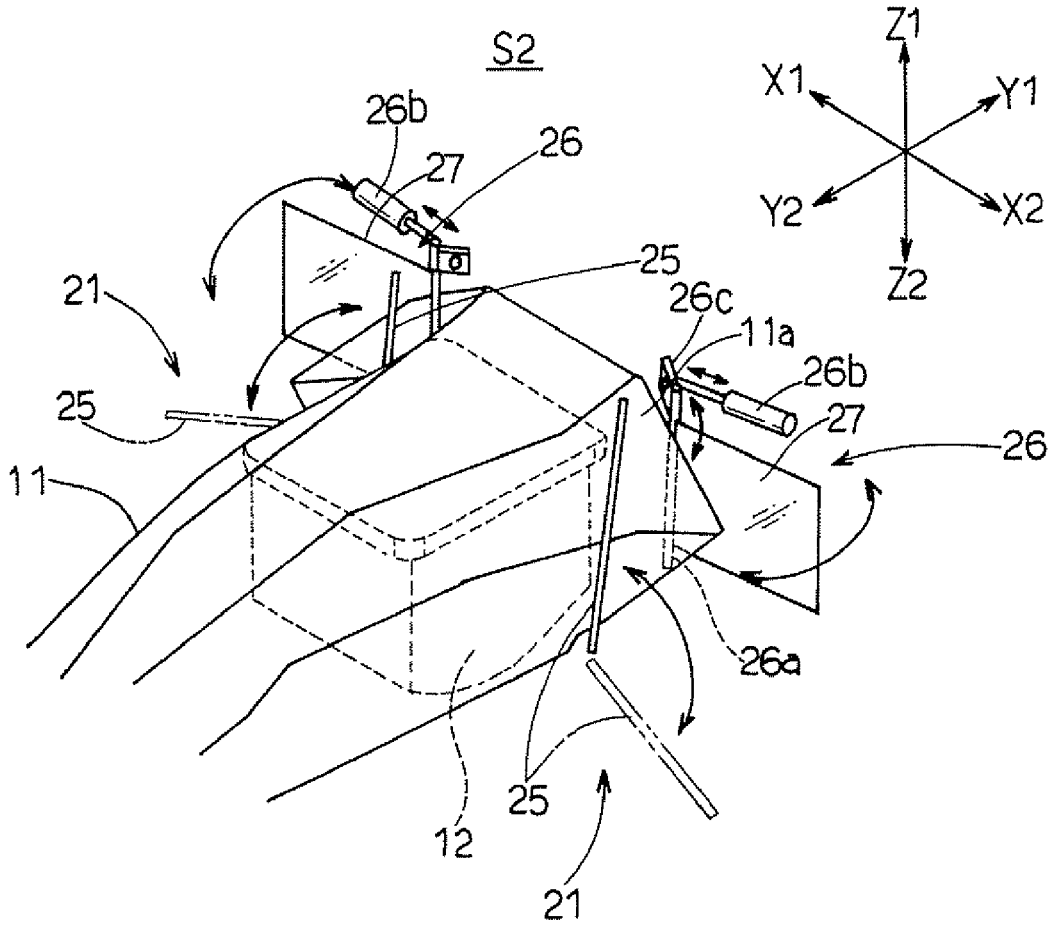
FIG. 3 is a perspective view showing a creasing means and a bag rear end ear portion folding means of a container packaging apparatus according to an embodiment of the present invention.
Figure 7:
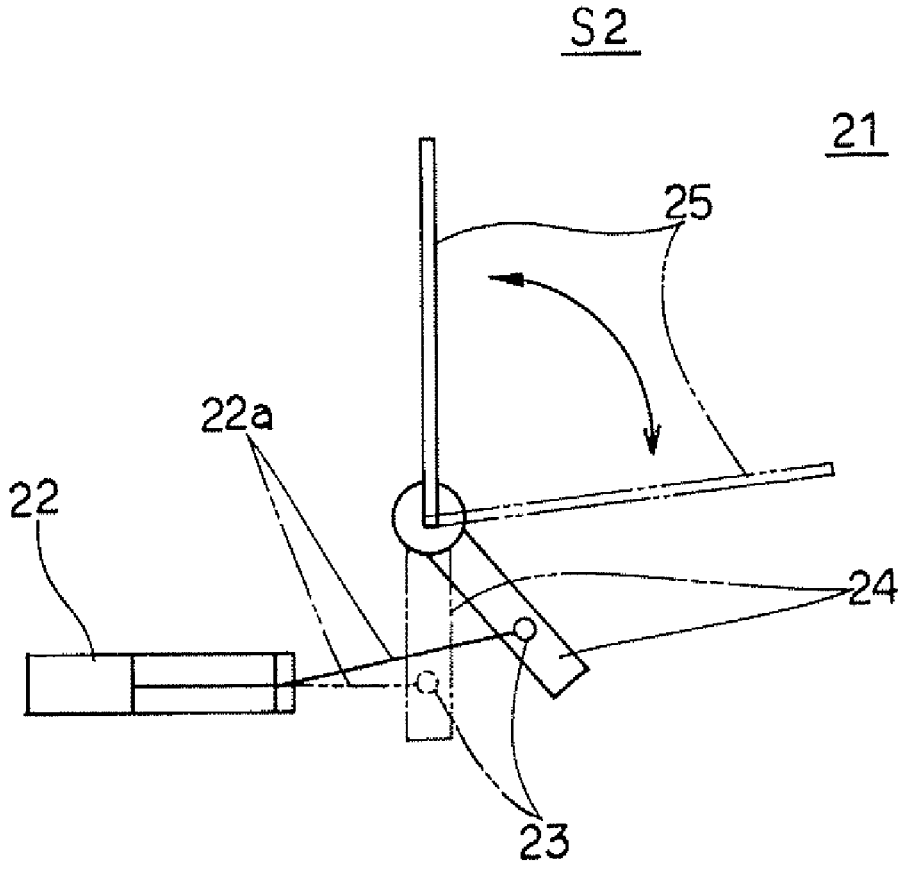
FIG. 7 is a front elevational view showing a creasing means of a container packaging apparatus according to an embodiment of the present invention.

The second stage S2 is further provided with a creasing means 21 for making a folding-back line in the site of the root of each of the triangular ear portions la emerging in both sides of the rear end portion of the packaging bag 11 after the wafer case 12 has been inserted into the packaging bag 11 and before the triangular ear portions 11*a* are folded back over each side of the container 12. The creasing means 21 is installed in the second stage S2 specifically in its lower space defined in the Y1 direction side with respect to the stationary frame 19*a*, and comprises a pair of left and right air cylinders 22 (a bar rising and falling means) mounted via a case carrier 50 and a pair of left and right ear folding and shaping bars 25 coupled to tip portions of rods 22*a* of respective air cylinders 22 via pivot pins 23 extending along the Y1-Y2 direction and links 24, each bar 25 serving as a folding-back guide for corresponding one of the triangular ear portions (FIG. 3 and FIG. 7). The case carrier 50 as mentioned above designates a table on which the wafer case 12 is placed immediately after its having been inserted into the bag.

Specifically, when the rods 22*a* of both air cylinders 22 are pushed out, each of the ear folding and shaping bars 25 exhibits a swing motion in a vertical plane around the pivot pin 23 so as to be pressed against a root of each triangular ear portion 11*a* in its side to be folded back consequently, air inside both of the triangular ear portions 11*a* can be pushed out of the triangular ear portions 11*a*. It is to be noted that the triangular ear portions 11*a* would have emerged as a result of the folding of both of the side portions of the packaging bag 11.

A container transfer table 51 is disposed between a central portion of the second stage S2 and a central portion of the fourth stage S4, which makes a reciprocating movement between the two stages, S2 and S4, via a belt conveyer C2 extending in the X1-X2 direction. The container transfer table 51 has a structure capable of accommodating the case carrier 50 in a space defined inside the transfer table 51 without having any contact with the case carrier 50 during moving into the second stage S2. A bag rear end ear folding means 26 is disposed in a top plate of the container transfer table 51 in its end portion defined in the Y1 side, which after the insertion of the container, is actuated to fold back each of the triangular ear portions 11*a* over respective sides of the wafer case 12, which ear portions 11*a* would have emerged in both sides of the rear end portions of the packaging bag 11.

The bag rear end ear folding means 26 comprises a pair of ear folding plates 27 capable of swinging horizontally around vertical shafts 26*a* as pivots disposed in end portions of the container transfer table 51 defined in its Y1 side, specifically one end in the X1 side and the other end in the X2 side, and a pair of air cylinders 26*b* disposed in the end portions of the container transfer table 51 defined in its Y1 side in proximity to the respective vertical shafts 26*a*. The ear folding plates 27 are spaced apart from each other by a distance a bit longer than the length of the wafer case 12 along the X1-X2 direction. The actuation of both of the air cylinders 26*b* to protrude the respective rods outward can cause a swing motion of the vertical shafts 26*a* rotatably coupled to tip portions of the respective rods via coupling elements 26*c*, so that each one of the ear folding plates 27 is actuated to fold back each one of the triangular ear portions 11*a*, which has been creased with the folding-back line in the site of the root thereof by each of the ear folding and shaping bars 25, toward the corresponding side surface of the case.

Figure 4:
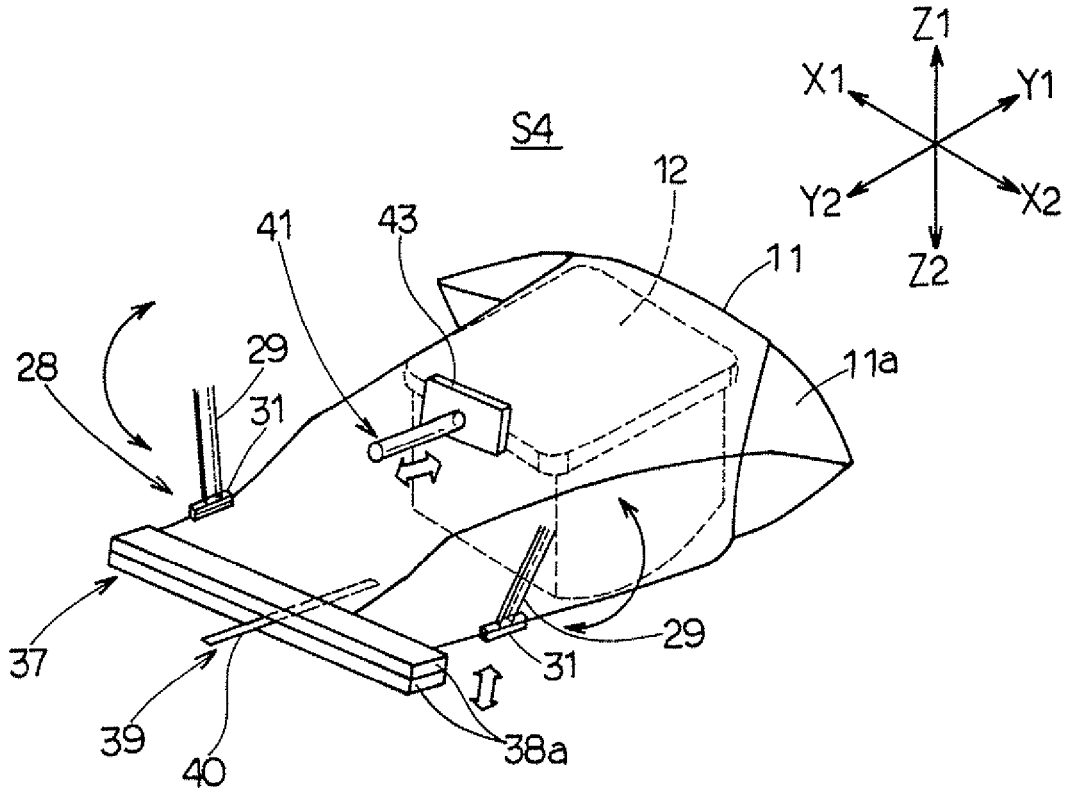
FIG. 4 is a perspective view showing a sealing means and a deaeration means for a packaging bag of a container packaging apparatus according to an embodiment of the present invention.
Figure 8:
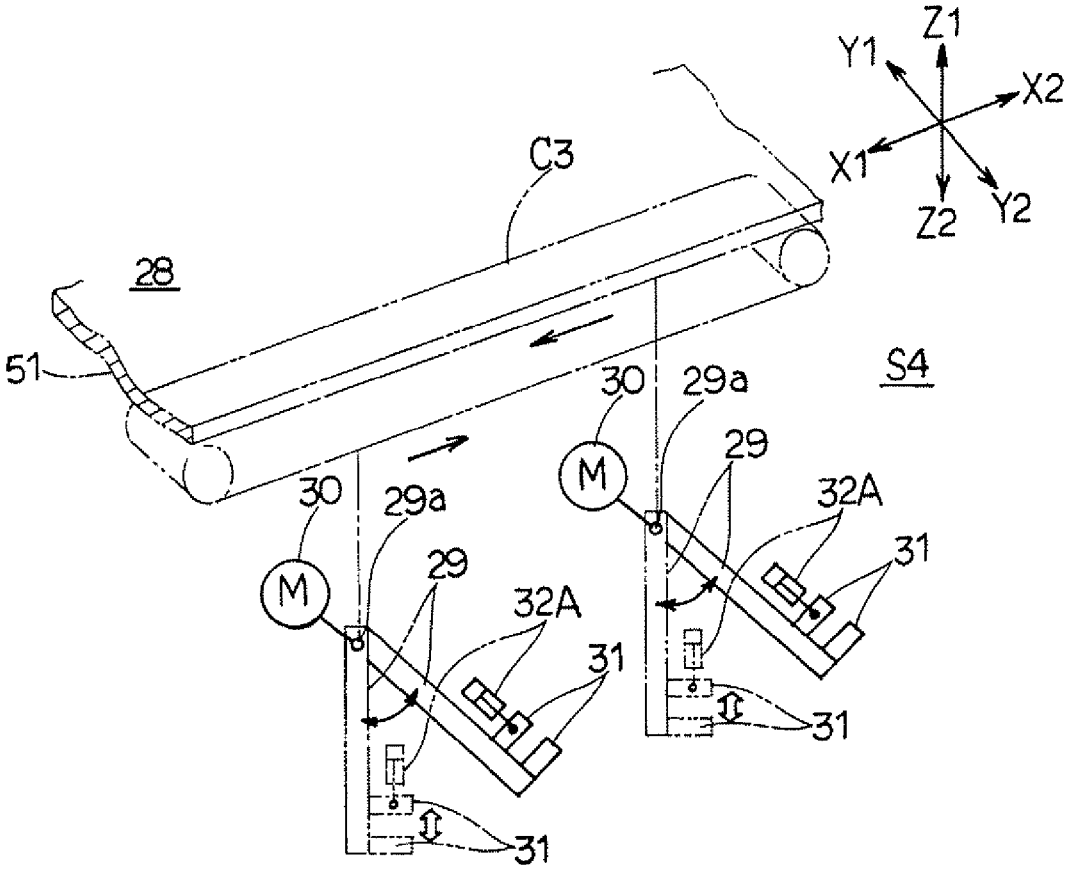
FIG. 8 is a front elevational view showing a side edge chuck means of a container packaging apparatus according to an embodiment of the present invention.

Further, a side edge chuck means 28 adapted to chuck the packaging bag 11 in both side edges defined in the opening side is disposed in a top plate of the container transfer table 51 in its end portion defined in the Y2 side (FIG. 4 and FIG. 8). The side edge chuck means 28 comprises: a pair of swing arms 29 rotatable around horizontal shafts 29*a* as pivots extending along the Y1-Y2 direction disposed in end portions of the top plate of the container transfer table 51, specifically one end in the X1 side and the other end in the X2 side; a pair of rotary motors 30 for actuating both swing arms 29 to make a swing motion; a total of two pairs of side edge chuck members 31, each one pair disposed in a tip portion of each one of the swing arms 29; and air cylinders 32A for causing each pair of side edge chuck members 31 to come closer to/part away from each other by protruding/retracting rods. Both of the swing arms 29 are spaced apart from each other by a distance a bit longer than the length of the wafer case 12 along the X1-X2 direction.

Specifically, the swing motion of each of the swing arms 29 around each of the horizontal shafts 29*a* as the pivot by each of the rotary motors 30 causes each pair of side edge chuck members to come closer to the each side edge in the proximity to the opening of the packaging bag 11. Then, protruding of the rod 32A of the air cylinder can actuate the side edge chuck members 31 so as to chuck each side edge of the packaging bag 1 between the paired side edge chuck members 31. Control of the tension applied to the opening region of the packaging bag 11 may be accomplished by changing the spacing between both swing arms 29 via an arm position control conveyer (belt conveyer) C3 extending in the X1-X2 direction across the full length of the end portion of the top plate of the container transfer table 51 defined in the Y2 side.

Figure 24:
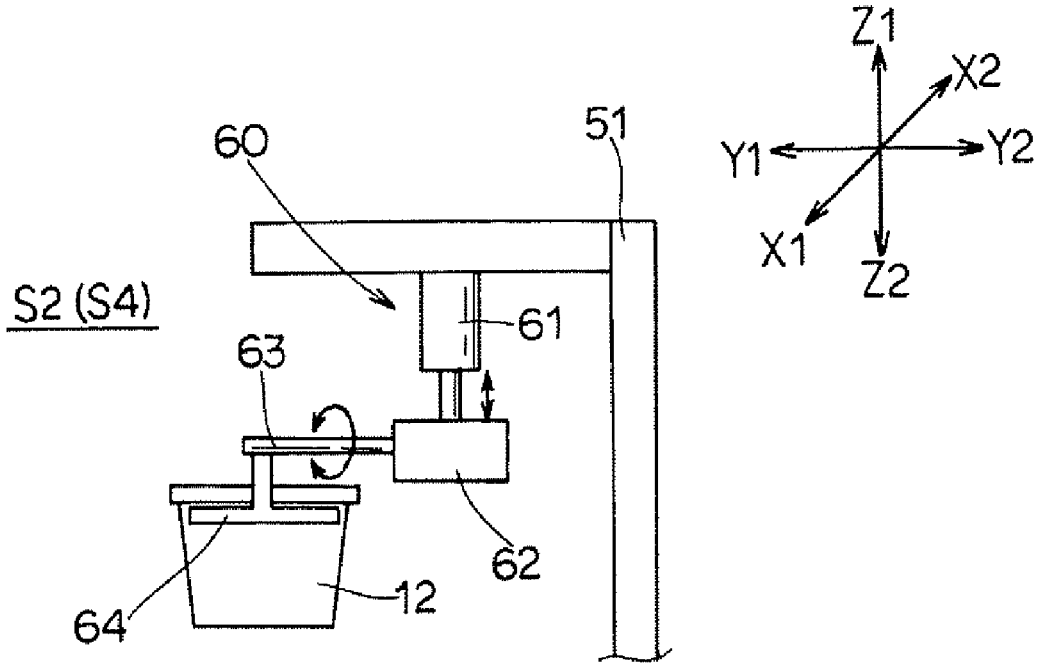
FIG. 24 is a side elevational view showing a case elevation means of a container packaging apparatus according to an embodiment of the present invention.

A case elevation means 60 is disposed on the top plate of the container transfer table 51, which is operable to pick up the wafer case 12 from the case carrier 50 (FIG. 24). The case elevation means 60 comprises: a pair of pick up cylinders 61 disposed in both end portions in the X1-X2 direction of the top plate of the container transfer table 51 and having rods heading downward; a pair of rotary motors 62 mounted fixedly to tip portions of the rods heading downward; and a pair of container clamping plates 64 mounted fixedly to tip portions of output shafts extending in the Y1-Y2 direction of respective rotary motors 62 and capable of supporting outwardly overhanging outer edge portions of a cover element of the wafer case 12, specifically both side portions along the X1-X2 direction, respectively from under side.

Specifically, both the rotary motors 62 are driven to rotate the output shafts and thereby to clamp by both container clamping plates 64 the cover of the wafer case 12 loaded on the case carrier 50. Then, both of the rods of the pickup cylinders 61 are retracted so as to pick up the wafer case 12 by a small distance from the case carrier 50. To release the picking up of the wafer case 12, a series of operations in the pickup procedure as described above should be performed in an inverse order.

Figure 17:
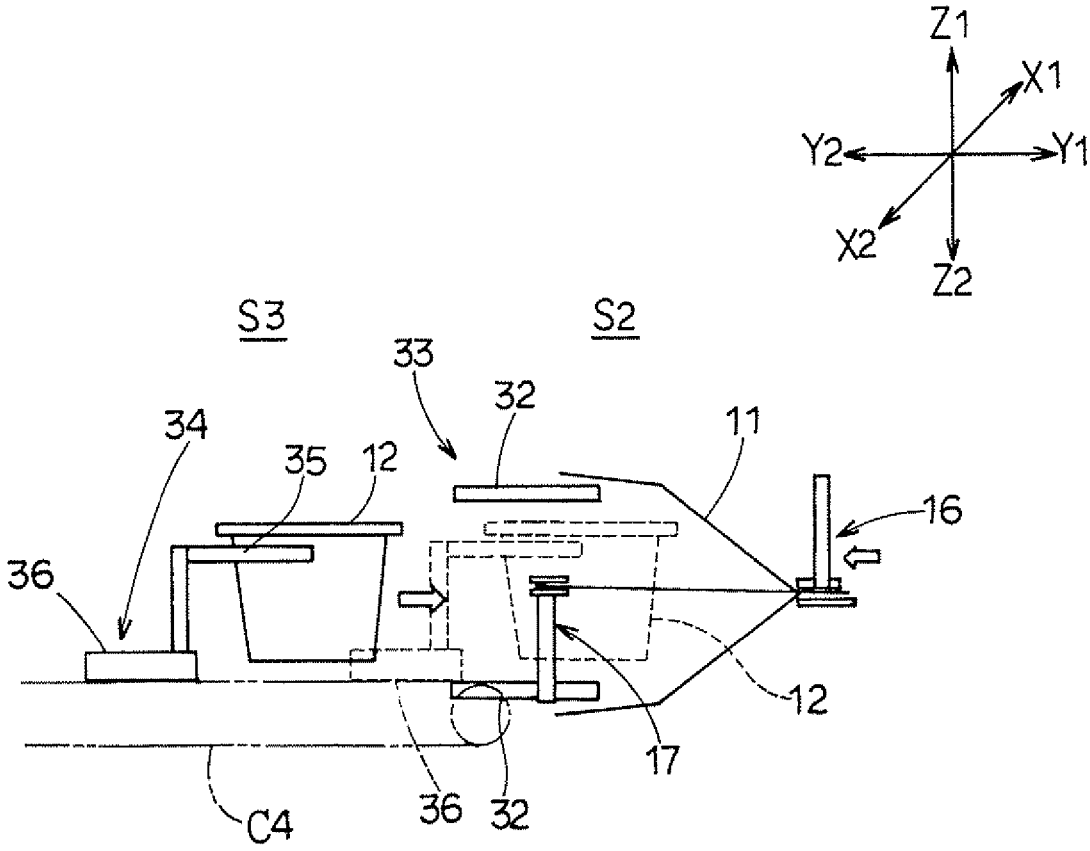
FIG. 17 is a side elevational view showing how a container is inserted into a packaging bag by a container packaging apparatus according to an embodiment of the present invention.

As seen from FIG. 1 and FIG. 17, an opening expansion means 33 having four expanding members 32 is disposed in the third stage S3. Each one of the expanding members 32, provided in the form of a bar extending in the Y1-Y2 direction, is retractably inserted into the packaging bag 11 through the opening. Then, the respective expanding members 32 are moved radially in the different directions from the approximately central location of the opening taken as the center (in the radial direction by every 90° along the circumference) to thereby expand an open area of the opening from the inside thereof.

Figure 15:
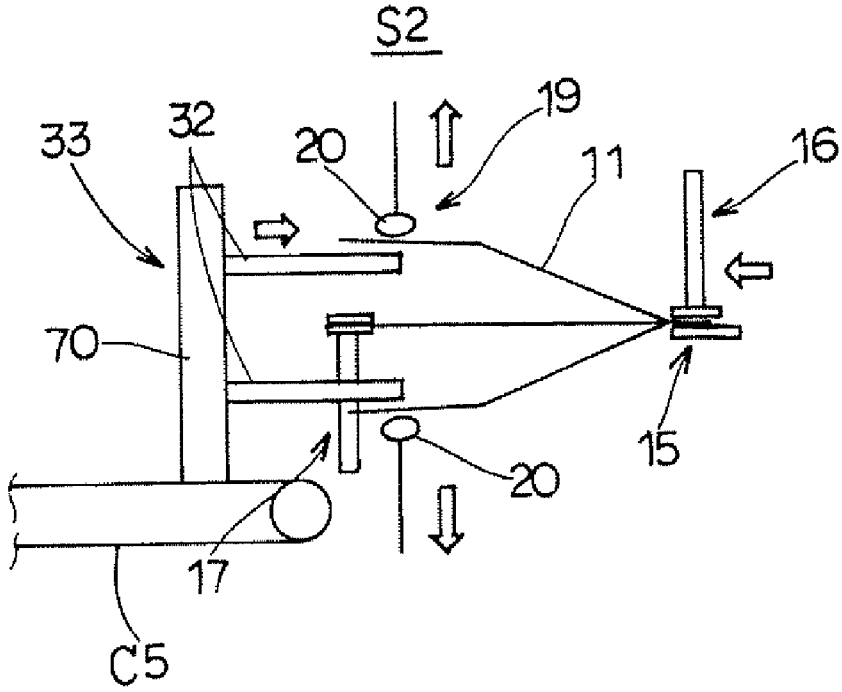
FIG. 15 is a side elevational view showing how a packaging bag is opened by a container packaging apparatus according to an embodiment of the present invention.

The opening expansion means 33 is disposed in an end portion of the third stage S3 in its Y1 side and has a rectangular movable base frame 70 whose width direction is in line with the Y1-Y2 direction (FIG. 15). The movable base frame 70 is sized to pass through an interior space of the stationary frame 19*a* as described above The movable base frame 70 is configured such that it can be advanced and retracted freely with respect to the packaging bag 11, that has been open within the second stage S2 zone, by the aid of a belt conveyer C5 extending in the Y1-Y2 direction disposed immediately beneath the movable base frame 70. A total of four air cylinders 71 are disposed in four corner portions of the movable base frame 70, each of which is operable to move each corresponding expanding member 32 in the radial direction from the approximately central location of the opening taken as the center by protruding/retracting a rod whose tip directed to an approximately central location of the movable base frame 70.

Specifically, to insert each of the expanding members 32 into the packaging bag 11, the rod of each air cylinder 71 is protruded so as to introduce the total of four expanding members 32 into the opened packaging bag 11 via the movable base frame 70 by the belt conveyer C5. To expand the opening of the packaging bag 11, the rods of the respective air cylinders 71 are simultaneously retracted. This can effectively move the four of expanding members 32 simultaneously in the radial directions from the approximately central location of the opening taken as the center to thereby expand the opening to a size sufficient for the wafer case 12 to be inserted into the bag without any interference.

In addition, a container insertion means 34 is disposed in the third stage S3, which is operable to insert the wafer case 12 into the packaging bag 11 through the opening. The container insertion means 34 comprises: a pair of container support bars 35 extending in the Y1-Y2 direction and capable of supporting the outwardly overhanging outer edge portions of the cover element of the wafer case 12, specifically both side portions in the X1-X2 direction from beneath thereof; an anchor table 36 by which each of the container support bars 35 is held in a cantilever manner; a pair of belt conveyers C4 that is longer than the belt conveyer C5 for the movable base frame 70 as described above and operable to make a reciprocating motion of the anchor table 36 substantially across the entire length of the third stage S3 along the Y1-Y2 direction. Both belt conveyers C4 are driven synchronously Specifically, both belt conveyers C4 are actuated to move the anchor table 36 in the Y1 direction to thereby catch the cover element of the wafer case 12 and thus hold the wafer case 12 in the cantilever manner by a pair of container support bars 35 in the course of the wafer case 12 being transferred, and then the anchor table 36, as in this condition, is further moved in the Y1 direction to thereby bring the wafer case 12 into the second stage S2 zone, where the wafer case 12 is inserted into the opened packaging bag 11.

As shown in FIGS. 4, 8, 20 and 21, a bag sealing means 37 is disposed in the fourth stage S4, which provides a heat seal (closing by heat) in the opening of the packaging bag 11. The bag sealing means 37 comprises a pair of upper and lower sealing bars (sealing members) 38*a* extending in the X1-X2 direction, which is disposed in an end of the fourth stage S4 in its Y2 side and equipped with electrically-heated wires embedded therein respectively, and a sealing air cylinder 37*a* for causing both the sealing bars 38*a* to come closer to/part away from each other. A rod of the air cylinder 37*a* is protruded outward to thereby cause both the sealing bars 38*a* to come closer to each other. Thus, the opening of the packaging bag 11 clamped between the pair of sealing bars 38*a* can be heat-sealed.

A deaeration means 39 is provided in the fourth stage S4, which serves to suck the internal air out of the packaging bag 11 during heat-sealing. The deaeration means 39 comprises a thin deaeration nozzle 40 disposed in an end portion of the fourth stage in its Y2 side and extending in the Y1-Y2 direction, and a nozzle advancing and retracting air cylinder 39*a* operable to drive the deaeration nozzle 40 to make a reciprocating motion in the Y1-Y2 direction to thereby bring/take a tip portion of the deaeration nozzle 40 into/out of the opening of the packaging bag 11. It is to be noted that the rear end portion of the deaeration nozzle 40 is in communication with a vacuum generator 39*b* disposed external to the container packaging apparatus 10 via a tube.

Figure 20:
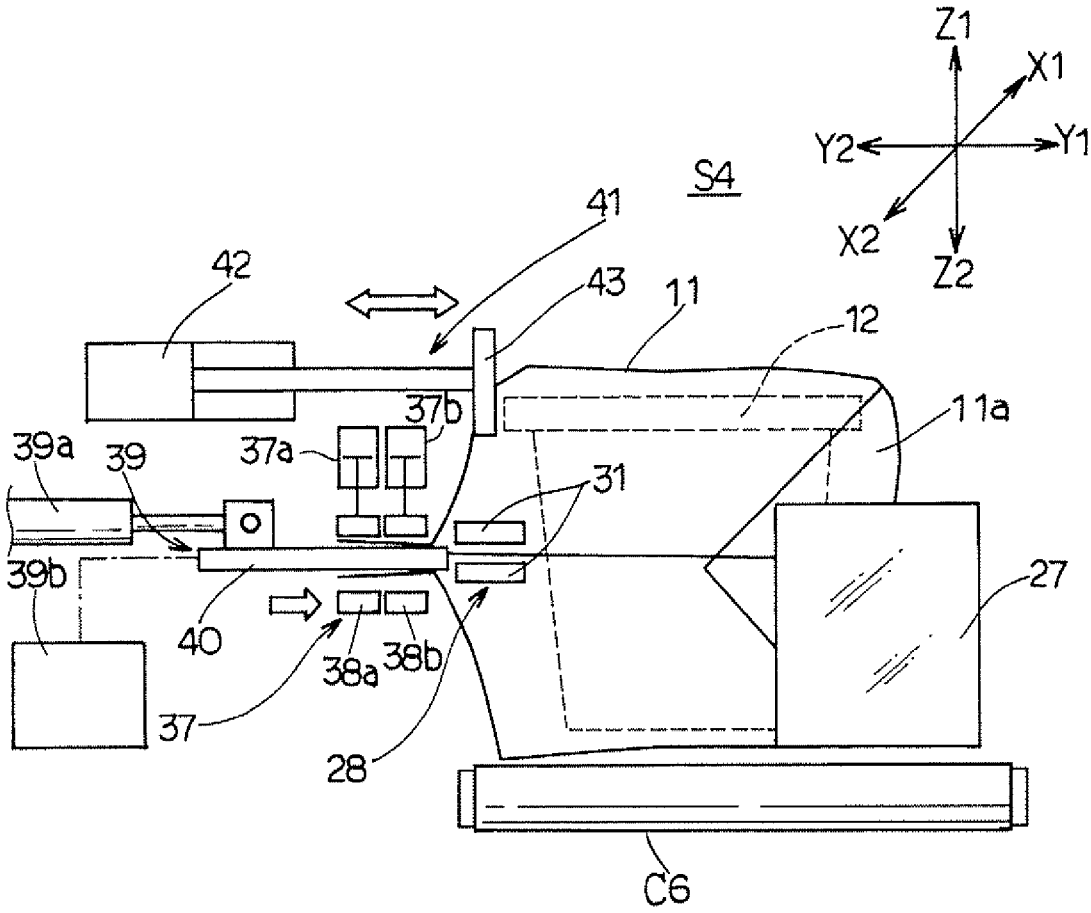
FIG. 20 is a side elevational view showing how the inside of a packaging bag is deaerated by a container packaging apparatus according to an embodiment of the present invention.
Figure 21:
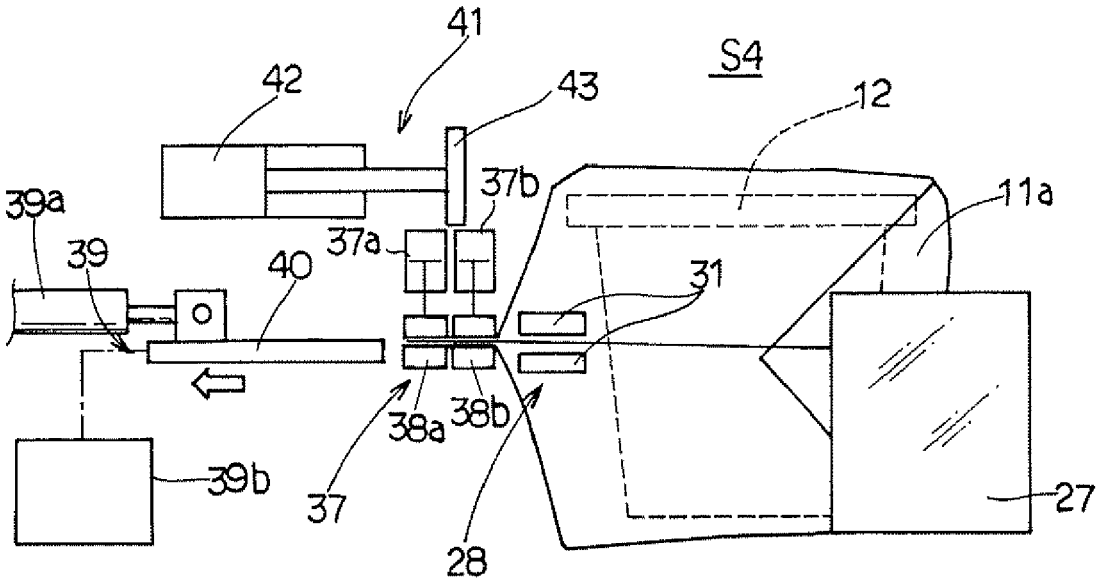
FIG. 21 is a side elevational view showing how a packaging bag is sealed by a container packaging apparatus according to an embodiment of the present invention.

Specifically, when the bag is to be sealed (during the bag being deaerated), firstly the tip portion of the deaeration nozzle 40 is inserted into the opening of the packaging bag 11 by the nozzle advancing and retracting air cylinder 39*a* (FIG. 20). Then, as in this condition, a rod of a pressing air cylinder 37*b* is protruded so as to seal the bag opening entirely by pressing bars 38*b*, and the packaging bag 11 is now evacuated of the internal air by a negative pressure from the vacuum generator 39*b* through the deaeration nozzle 40. After the packaging bag 11 having been evacuated of the air, the tip portion of the deaeration nozzle 40 is with drawn out of the bag by the nozzle advancing and retracting air cylinder 39*a*, and then the rod of the sealing air cylinder 37*a* is protruded so as to apply a heat-sealing to the opening region of the packaging bag 11 clamed between both sealing bars 38*a* (FIG. 21). During the heat-sealing operation, with the aid of the pressing bars 35*b* providing the sealing across the entire bag opening, the opening region of the packaging bag 11 can be heat-sealed, as its having been evacuated of the air.

A container positioning means 41 for placing the wafer case 12 in position within the packaging bag 11 during the deaeration is provided in the fourth stage S4 (FIGS. 4, 9, 20 and 21). The container positioning means 41 comprises a positioning air cylinder 42 disposed in an intermediate location along the longitudinal direction in the end portion of the fourth stage S4 in its Y2 side with a tip of a rod thereof facing to the Y1 direction. A stopper plate 43 is fixedly mounted to the tip portion of the rod, which is in operation pressed against an edge of the cover of the wafer case in its Y2 side from outside of the packaging bag 11 so as to restrict the migration of the wafer case 12 to the Y2 side within the bag due to the deaeration work.

Specifically, during the bag being sealed, the rod of the positioning air cylinder 42 is pushed out prior to the deaeration such that the stopper plate 43 is brought into abutment on the edge of the cover of the wafer case 12 in its Y2 side from outside of the packaging bag 11. Thus, the migration of the wafer case 12 to the Y2 side within the bag during the subsequently conducted deaeration work can be restricted. Consequently, the triangular ear portions of the packaging bag 11 emerging in the bag front end and the bag rear end can assume as designed in shape and size thereof, thus providing the wafer case 12 with a higher level quality of packaging.

A transport conveyer C6 is provided across a lower portion of the fourth stage S4 and a lower portion of the fifth stage S5, which is operable to feed the wafer case 12 as in the course of packing from the fourth stage S4 to the fifth stage S5.

Figure 5:
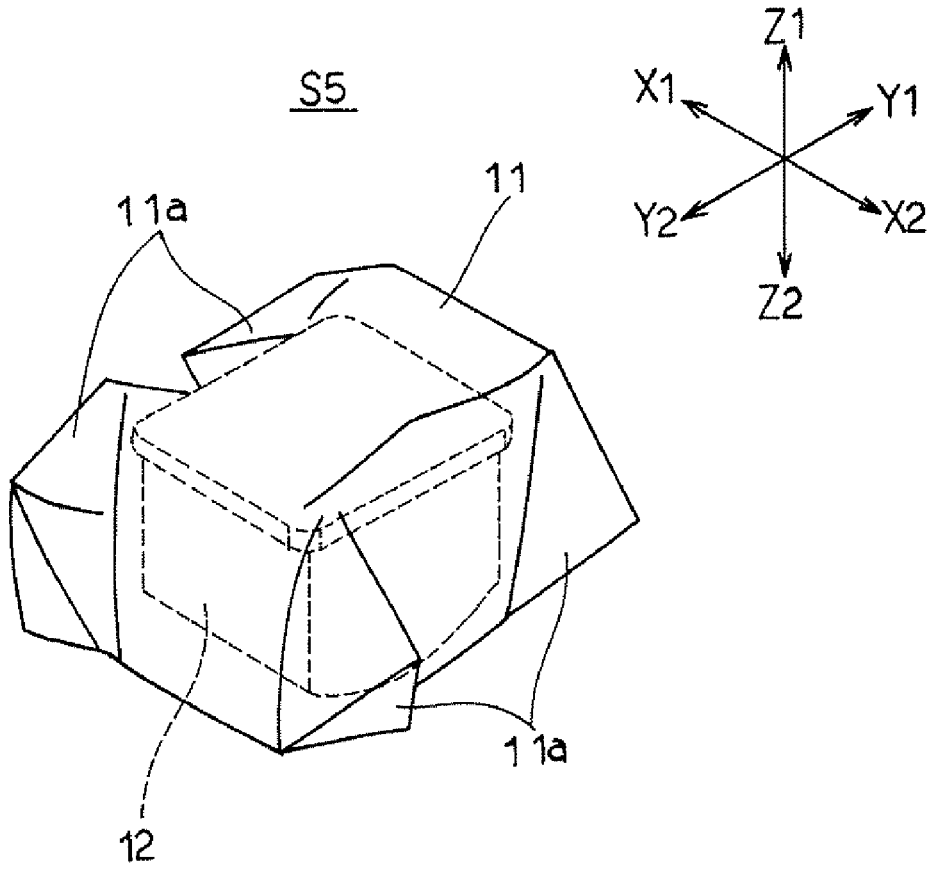
FIG. 5 is a perspective view showing a state of a packaging bag including a container packed inside thereof before an operation of folding back triangular ear portions in a container packaging apparatus according to an embodiment of the present invention.

A bag front end ear folding means 44 and a bag rear end ear folding means 26A are arranged in the fifth stage S5 (FIG. 6), which is operable to fold back the triangular ear portions 11*a* (FIG. 5) that have emerged in both sides of the front end portion as well as in both sides of the rear end portion of the packaging bag 11, so as to ride on both side surfaces of the wafer case 12.

The bag front end ear folding means 44 and the bag rear end ear folding means 26A are substantially identical in configuration with the bag rear end ear folding means 26 disposed in the container transfer table 51 of the second stage S2, excluding that those two means 44 and 26A are positioned symmetrically in the end of the fifth stage S5 in the Y1-Y2 side.

Figure 6:
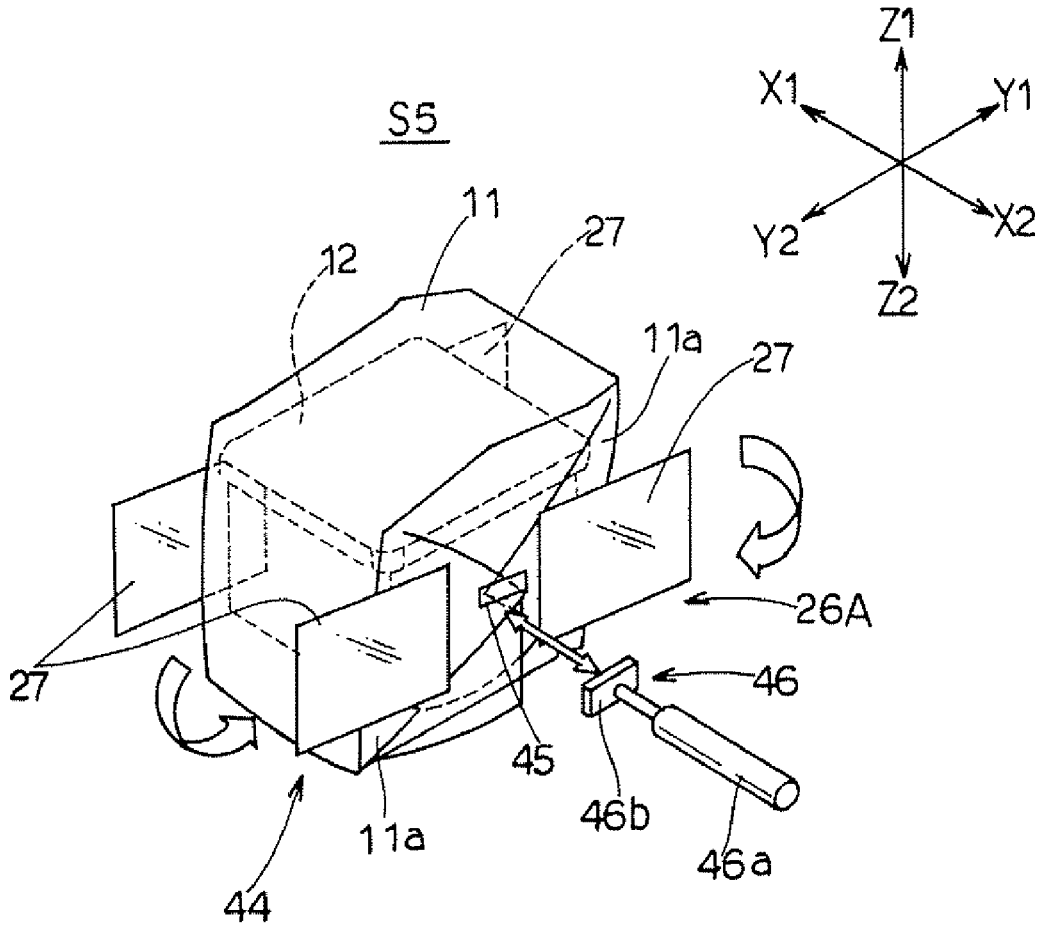
FIG. 6 is a perspective view showing a bag front end ear folding means and a bag rear end ear folding means for respective triangular ear portions of a container packaging apparatus according to an embodiment of the present invention.

The fifth stage S5 is further provided with a tape attaching means 46 for settling the front and the rear ends of the packaging bag 11 by attaching a length of adhesive tape 45 transversely across the tip portions of the both triangular ear portions 11*a* located oppositely in the both sides of the wafer case 12 (FIG. 6 and FIG. 22Y. The tape attaching means 46 is individually disposed in end portions of the fifth stage F5, specifically one end in the X1 side and the other end in the X2 side, and has a pair of tape air cylinders 46*a* having tips of rods thereof positioned oppositely to each other and a pair of tape dispenser 46*b*, each disposed in the tip portion of the rod and capable of suppling a predetermined length of adhesive tape 45.

Specifically, a predetermined length of tape 45 is supplied by each of the tape dispensers 46*b* and subsequently the rod of each one of the tape air cylinders 46*a* is pushed out. By this operation, the adhesive tape 45 is attached transversely across both of the triangular ear portions 11*a* in both of the bag front side and the back rear side, which are oppositely positioned in respective sides of the wafer case 12.

Figure 10:
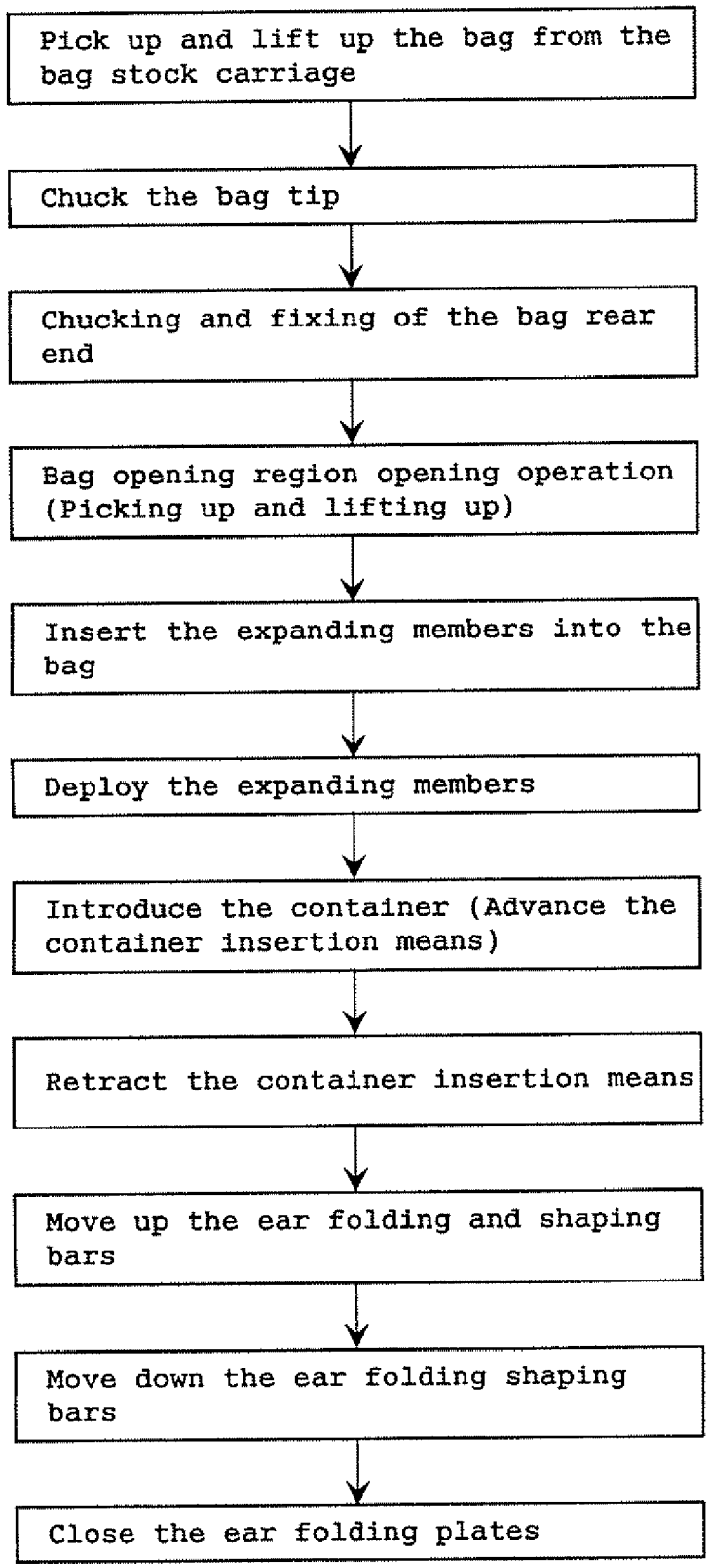
FIG. 10 is a flow chart showing a set of operations in a container packaging apparatus according to an embodiment of the present invention.
Figure 11:
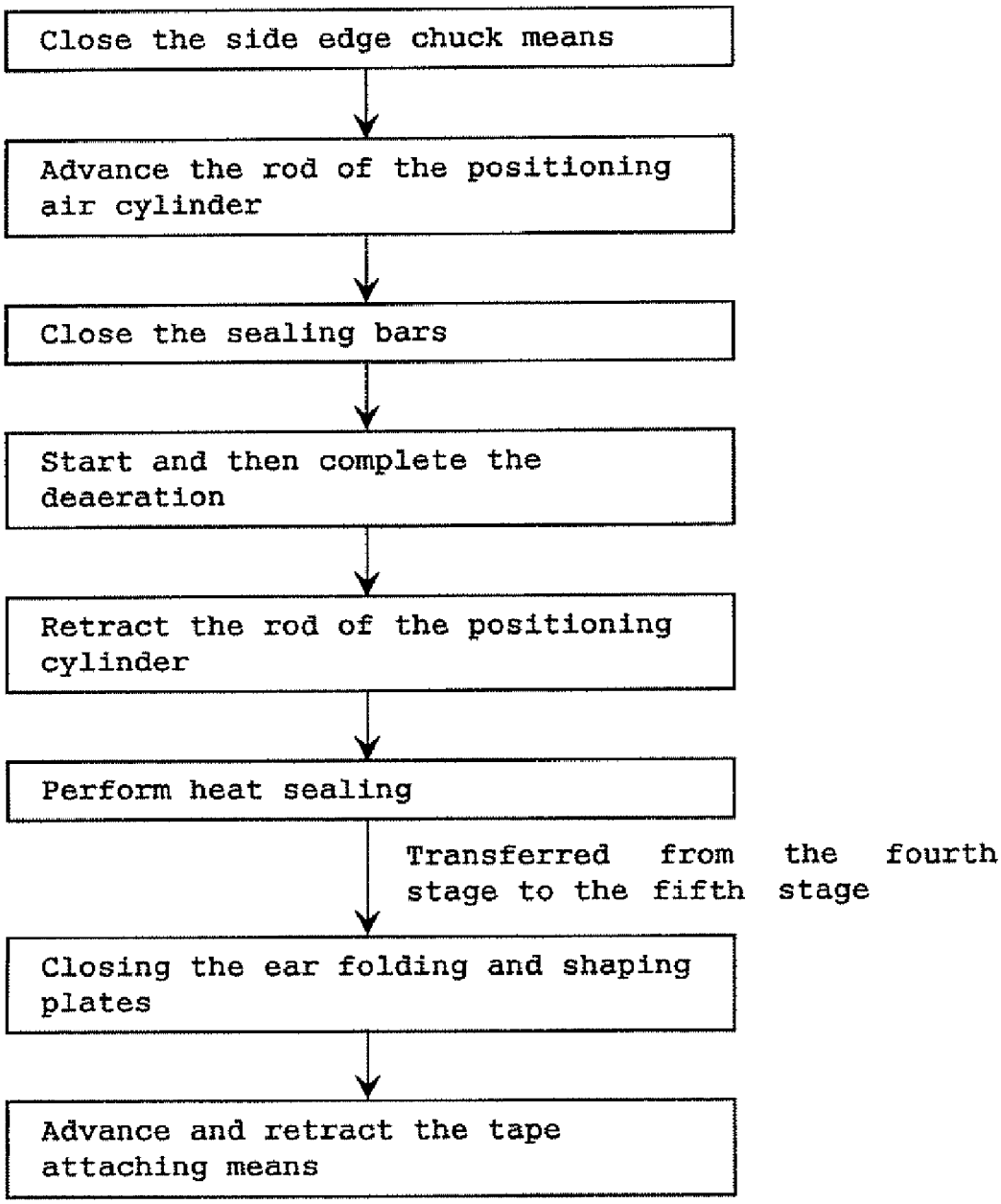
FIG. 11 is a flow chart showing another set of operations in a container packaging apparatus according to an embodiment of the present invention.

An operation of the container packaging apparatus 10 according to an embodiment of the present invention will now be described with reference to flow sheets of FIGS. 10 and 11.

The bag stock carriage 13 loaded with a plurality of packaging bags is previously placed in the first stage S1. In this connection, the opening of each packaging bag 11 is directed toward the Y2 direction and the end portion of the bag stock carriage 13 in the Y2 side is positioned within the second stage S2 zone.

Figure 13:
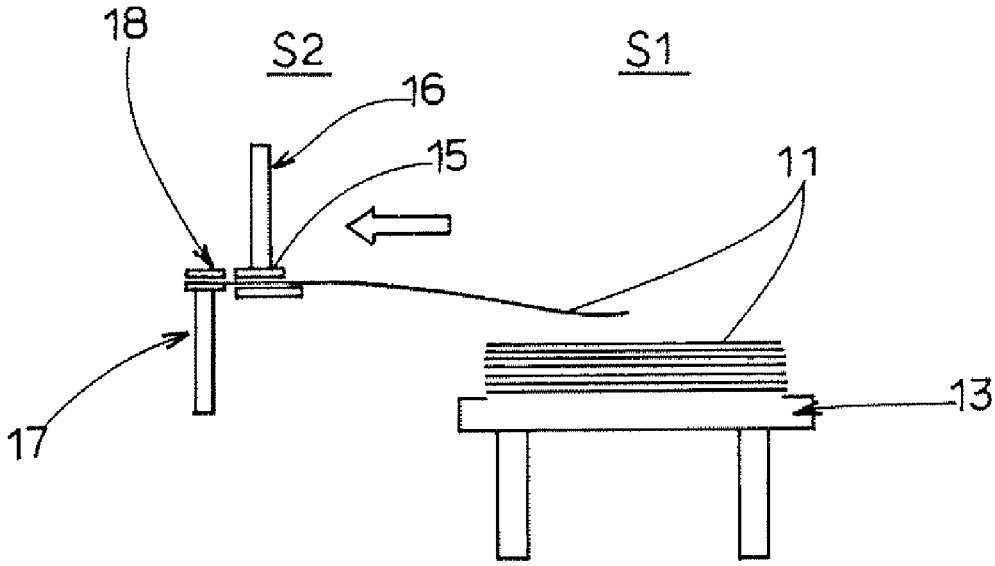
FIG. 13 is a side elevational view showing how the packaging bag that has been picked up is then drawn out by a container packaging apparatus according to an embodiment of the present invention.

Subsequently, the respective pickup pads 14 and both of the bag rear end fixing members 15 are simultaneously moved up/down by the elevating air cylinder 16*a* above the end of the second stage S2 in its Y1 side, so that the packaging bag 11, specifically the bag placed on the top of the pile of packaging bags loaded on the bag stock carriage 13, can be held by vacuum chuck and then lifted up at a region proximal to the opening (FIG. 12). Immediately after this operation, the rod of the bag rear end chucking air cylinder 16*c* is retracted so as to cause the both bag rear end fixing members 15 to chuck the packaging bag 11 in the opening region. As in this condition, the elevating plate 16*b* is transferred to the Y2 side of the second stage S2 zone by the bag rear end fixing conveyer C1 so that the packaging bag 11 that has been picked up can be transferred in its entirety to the second stage S2 zone (FIG. 13).

After that, both swing arms 17*b* are driven by respective associated swing motion actuating air cylinders 17*c* so as to make a swing motion to thereby place, in either side with respect to the tip portion (the opening region) of the packaging bag 11, each corresponding to one of the tip side edge chuck members 18 in position. Next, by both of the chucking air cylinders 17*e*, their associated upper and lower bag tip side edge chuck members 18 are moved in the direction to come closer to each other to thereby chuck the tip portion of the packaging bag 11 in both side portions thereof. To control the tension applied to the tip portion of the packaging bag 11, the position control conveyer 17*d* is actuated so as to cause both swing arms 17*b* in association with the swing motion actuating air cylinders 17*c* to come closer to/part away from each other for controlling the tension.

Figure 14:
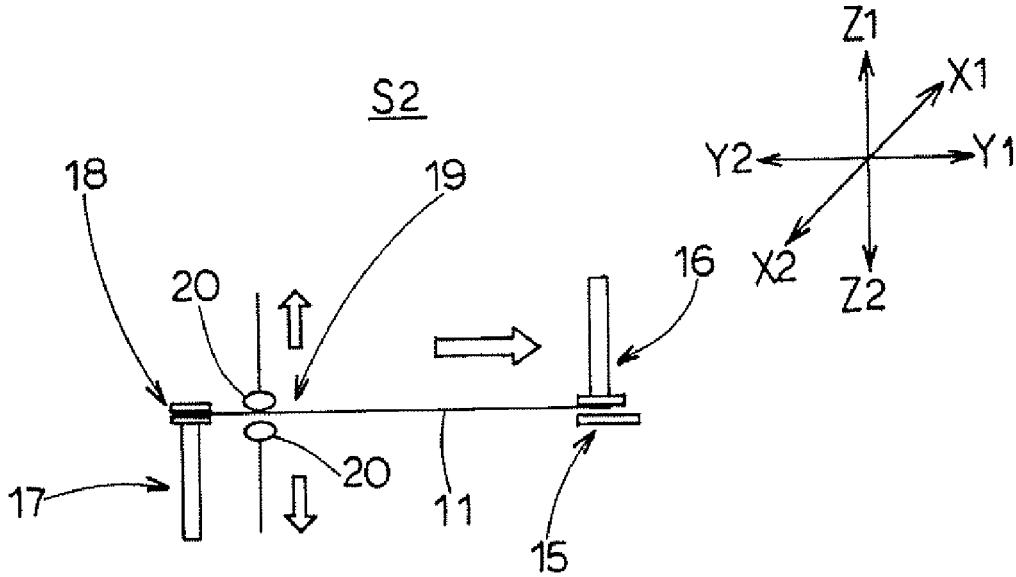
FIG. 14 is a side elevational view showing a state of a packaging bag immediately before its being opened by a container packaging apparatus according to an embodiment of the present invention.

In next operation, the rod of the bag rear end chuck air cylinder 16*c* is pushed out so as to release the chucking of the bag tip portion by the respective bag rear end fixing members 15. Then, the elevating plate 16*b* is returned back to the Y1 side end portion of the second stage S2 by the bag rear end fixing conveyer C1. In this connection, the rod of the bag rear end chucking air cylinder 16*c* is again retracted so as for the upper and the lower bag rear end fixing members 15 to chuck the rear end portion of the packaging bag 11 (FIG. 14).

Subsequently, in operation of the bag opening means 19, both of the air cylinders 19*b* are actuated to push out the rods synchronously to thereby hold by vacuum chuck the upper and the lower sides of the packaging bag 11 in its opening region with two pairs of upper and lower opening pads 20. Then, by the respective air cylinders 19*b*, the associated rods are retracted synchronously so as to part the two pairs of upper and lower opening pads away from each other by a predetermined distance therebetween. Thus, the packaging bag 11 is opened in the site of the opening region (FIG. 15).

Figure 16:
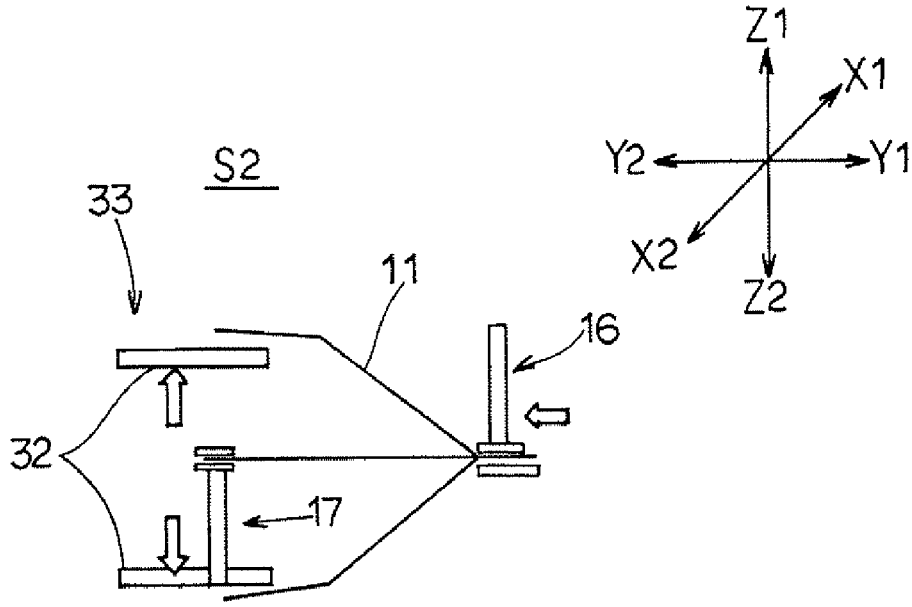
FIG. 16 is a side elevational view showing how an opening of a packaging bag is expanded by a container packaging apparatus according to an embodiment of the present invention.

Subsequently, in operation of the opening expansion means 33, the rod of each air cylinder 71 is pushed out and the four expanding members 32 are inserted into the opened packaging bag 11 by the belt conveyer C5 via the movable base frame 70 mounted thereon. Then, the rods of respective air cylinders 71 are retracted synchronously to thereby move the four expanding members 32 simultaneously in the radial directions from the approximately central location of the opening taken as the center. Thus, the opening of the packaging bag 11 would be expanded to a sufficiently large size to accommodate the wafer case 12 to be inserted (FIG. 16).

Next operation is to insert the wafer case 12 into the packaging bag 11 (FIG. 17) Specifically, in operation of the container insertion means 34, the anchor table 36 is transferred in the Y1 direction by the belt conveyer C4. Consequently, in the course of this transfer, the cover of the wafer case 12 is caught by a pair of container support bars 35. Thus, the anchor table 36 is further moved in the Y1 direction, while the wafer case 12 being held in the cantilever manner, to thereby transport the wafer case 12 into the second stage S2 zone, where the wafer case 12 is inserted into the packaging bag 11 that has been opened in the site of the opening region.

After this operation, the container support bar 35 is pulled back to position by the belt conveyer C4 of the container insertion means 34. Further, in operation of the opening expansion means 33, the rods of respective air cylinders 71 are pushed out synchronously so as to move the four expanding members 32 in the direction toward the approximately central location of the opening, while at the same time the respective expanding members 32 are withdrawn out of the packaging bag 11. Additionally, in operation of the bag rear end chuck means 16, the rod of the bag rear end chucking air cylinder 16*c* is pushed out to thereby release the chucking of the bag rear end portion (FIG. 18).

Figure 18:
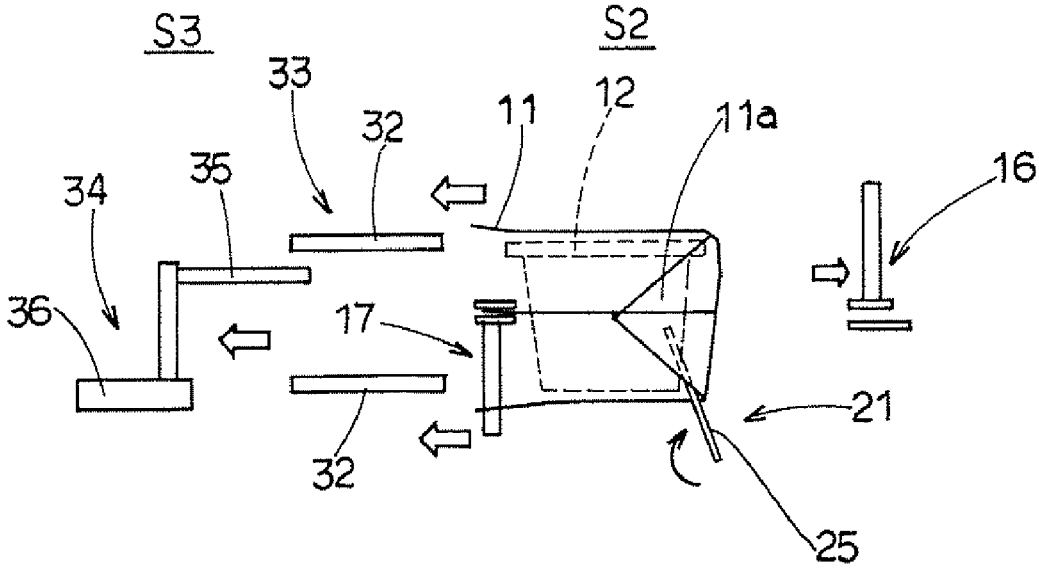
FIG. 18 is a side elevational view showing how a folding-back line of a triangular ear portion in the bag rear end portion is creased by a container packaging apparatus according to an embodiment of the present invention.

Next, in operation of the creasing means 21, the rods 22*a* of both of the air cylinders 22 are pushed out (FIG. 7 and FIG. 18). Accordingly, each of the ear folding and shaping bars 25 is driven to make a swing motion in a vertical plane around the pivot pin 23 to bring the ear folding and shaping bar 25 into abutment on the root of each triangular ear portions 11*a*, where the ear folding and shaping bar 25 is pressed against the triangular ear portion in the fold-back side thereof. Consequently, prior to the opening of the packaging bag 11 being opened, the internal air within both of the triangular ear portions 11*a* is pressed out of the corresponding triangular ear portions 11*a*.

As a result, in the subsequent step of carrying out the folding back operation of both triangular ear potions 11*a* onto the side surfaces of the container, base lines creased for the folding back (i.e., the folding-backlines) in the respective triangular ear portions 11*a* defined in the site of root portion thereof can be stable. Consequently, the triangular ear portions 11*a* in both sides of the bag rear end portion can emerge uniformly in size and shape and thus the packaging of the container with a resultant high level of quality can be provided in a stable manner.

Figure 19:
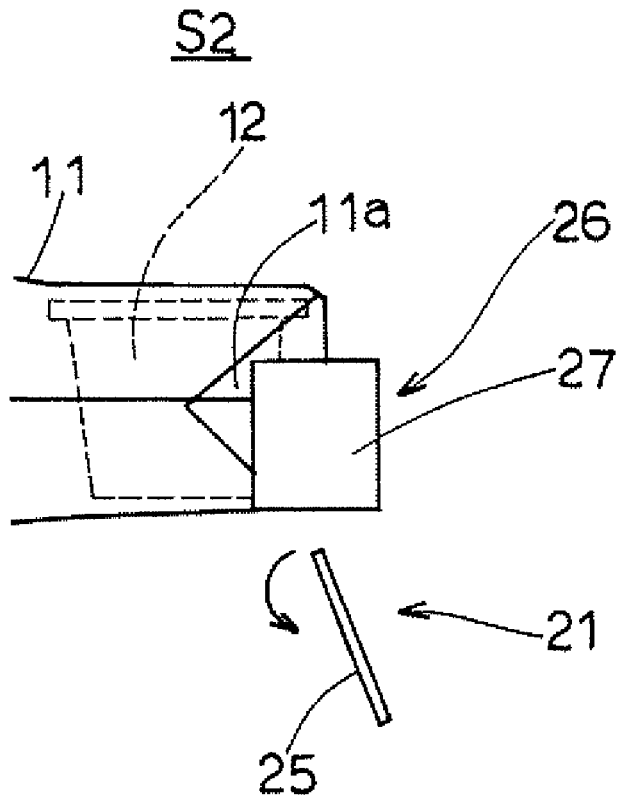
FIG. 19 is a side elevational view showing how a triangular ear portion in the bag rear end portion is folded back by a container packaging apparatus according to an embodiment of the present invention.

After the folding back lines having been made, the rods of both of the air cylinders 22 are retracted to thereby rotate both ear folding and shaping bars 25 downward around the pivot pins 23 into their lying rest positions (FIG. 19). Then, in operation of the bag rear end ear folding means 26, the rods of both of the air cylinders 26*b* are pushed out synchronously. This operation can cause a swing motion of the vertical shaft 26*a* rotatably coupled to the tip portion of each rod, so that each of the ear folding plates 27 can fold back each triangular ear portion 11*a* creased with the folding back line in its root portion by the ear folding and shaping bar 25 to ride on the corresponding side surface of the case.

Next, the container transfer table 51 is moved from the second stage S2 to the fourth stage S4 by the belt conveyer C2 between the second stage S2 and the fourth stage S4. At that time, in operation of the case elevation means 60, the output shafts 63 are rotated by both of the rotary motors 62 so as for the container clamping plates 64 to clamp the cover of the wafer case 12 loaded on the case carrier 50. After that, the rods of both of the pickup cylinders 61 are retracted to thereby allow the wafer case 12 to be picked up a small distance from the case carrier 50.

Subsequent to the transfer operation to the fourth stage S4 zone, in operation of the side edge chuck means 28 of the container transfer table 51, the both swing arms 29 are driven by both of the rotary motors 30 to make a swing motion around the horizontal shafts 29*a* (FIG. 8 and FIG. 20). This operation brings each pair of side edge chuck members 31 closer to the both side edges of the packaging bag 11 adjacent to the opening. Then, the rods of the air cylinders 31 are pushed out to cause each pair of side edge chuck members 31 to chuck the packaging bag 11 in both side edges between the side edge chuck members 31. To control the tension applied to the opening region of the packaging bag 11, a distance between the both rotating arms 29 can be changed by the arm position control conveyer C3 for adjusting the tension.

Figure 9:
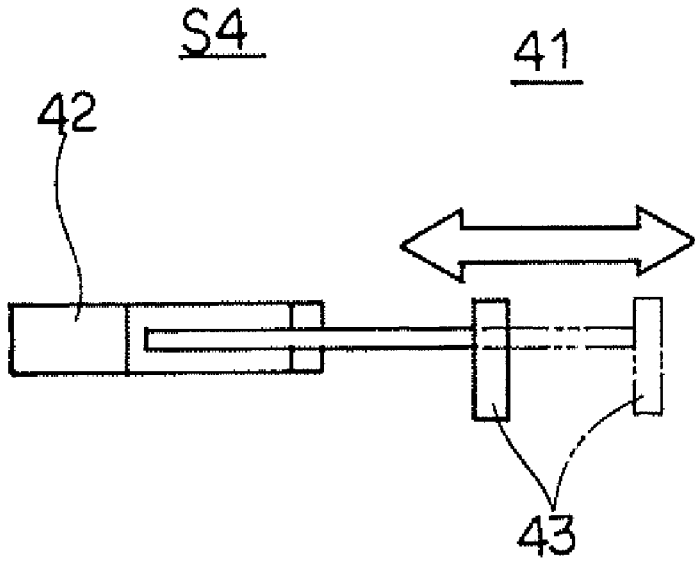
FIG. 9 is a front elevational view of a container positioning means of a container packaging apparatus according to an embodiment of the present invention.

Then, in operation of the container positioning means 41, to seal the bag, the rod of the positioning air cylinder 42 is pushed out prior to the deaeration so as to bring the stopper plate 43 into abutment on the cover of the wafer case 12 in its Y2 side from outside of the packaging bag 11 (FIG. 9 and FIG. 20). This can restrict the migration of the wafer case 12 to the Y2 side within the bag during the subsequent deaeration work. As a result, the triangular ear portions 11*a* of the packaging bag 11 in the bag front end and the bag rear end can emerge as designed in size and shape and thus the packaging for the wafer case 12 with a higher level of quality can be provided.

Subsequently, in operation of the bag sealing means 37, the tip portion of the deaeration nozzle 40 is inserted into the opening of the packaging bag 11 by the nozzle advancing and retracting air cylinder 39*a* (FIG. 20). After that, as in the condition of the opening region of the packaging bag 11 being placed between the pressing bars 38*b*, the rod of the pressing air cylinder 37*b* is protruded. This allows the both pressing bars 38*b* to clamp the opening region of the packaging bag 11 therebetween, and as in this condition, the deaeration of the bag is carried out by a negative pressure from the vacuum generator 39*b*. After the deaeration operation having been completed, the tip portion of the deaeration nozzle 40 is withdrawn out of the bag by the nozzle advancing and retracting air cylinder 39*a*, and the rod of the sealing air cylinder 37*a* is then protruded so as to apply a heat-sealing to the opening region of the packaging bag 11 clamed between both sealing bars 38*a* (FIG. 21). During the heat-sealing operation, the pressing bars 38*b* provide the sealing across the entire bag opening, and so the opening region of the packaging bag 11 can be heat-sealed, as its having been evacuated of the air.

After that, in operation of the container positioning means 41, the rod of the positioning air cylinder 42 is retracted to thereby part the stopper plate 43 away from the cover of the wafer case 12 (FIG. 21).

Then, the wafer case 12 as contained in the bag that has been closed is placed on the transport conveyer C6 by the case elevation means 60. The wafer case is then transported from the fourth stage S4 to the fifth stage S5 by the transport conveyer C6.

Figure 22:
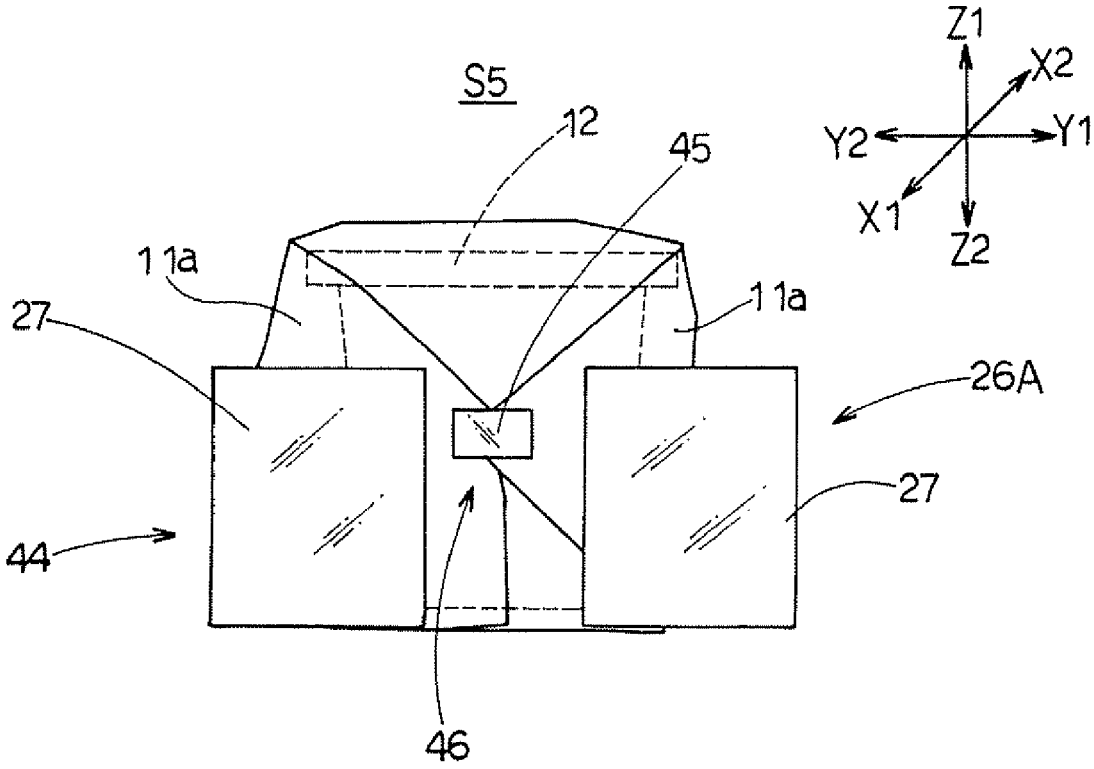
FIG. 22 is a side elevational view showing how a triangular ear portion of a packaging bag is fixed with tape by a container packaging apparatus according to an embodiment of the present invention.

In the fifth stage S5, the respective triangular ear portions 11*a* in the front and the rear end portions of the packaging bag 11 are folded on the side surfaces of the case by the bag front end ear folding means 44 and the bag rear end ear folding means 26A, respectively (FIG. 22).

After that, in operation of the tape attaching means 46, a predetermined length of tape is fed from each of the tape dispensers 46*b* and then the rod of each of the tape air cylinder 46*a* is pushed out. By this operation, the adhesive tape 45 can be attached transversely across the both triangular ear portions 11*a* formed in either of the bag front side and the bag rear side as located oppositely on both side surfaces of the wafer case 12.

As understood from the description above, since in the container packaging apparatus 10 of the illustrative embodiment of the present invention, both side ends of the opening of the packaging bag 11 are positioned and held in place by the side edge chuck means 28 during the deaeration operation, therefore the development of crimps in the sealed area of the packaging bag 11 can be suppressed, so that the high level of sealing property of the packaging bag 11 and thus the packaging of the wafer case 12 with the resultant high level of quality in the stable manner can be obtained.

In addition, since the migration of the wafer case 12 within the packaging bag 11 during the deaeration operation can be restricted with the aid of the container positioning means 41, therefore the solution can be provided to eliminate the unevenness in size and shape between the left and the right triangular ear portions 11*a* in the front and the rear end portions of the packaging bag 11 resultant from the migration of the wafer case 12 within the packaging bag 11 during the deaeration operation. Consequently, it becomes possible to provide the packaging of the wafer case 12 with a much higher level of quality and the more stable manner.

What is claimed is:

1. A container packaging apparatus comprising:

a bag opening member for opening an opening region defined exclusively in a tip end portion of a packaging bag transversely-mounted on a conveyor;

a container insertion member for inserting a container into said packaging bag through said opening region that is opened;

a sealing member having a pair of upper and lower portions for vertically sandwiching and subsequently heat-sealing said opening region of said packaging bag into which said container has been inserted;

a deaeration nozzle for exhausting air inside said packaging bag, the deaeration nozzle being inserted from a space defined in said sealing member into said packaging bag through said opening region, after said opening region of said packaging bag is sandwiched and before it is heat-sealed; and a side edge chuck member for tensioning the opening region by fixing both side ends having a predetermined distance in between during a deaeration operation by said deaeration nozzle, the side ends being engaged by the side edge chuck member between said opening region of said packaging bag and the insertion position of said container.

2. The container packaging apparatus in accordance with claim 1, further comprising a container positioning member comprising:

a positioning air cylinder having one end of a rod pointing in a direction in which said container is inserted into said packaging bag; and a stopper plate fixed at an end portion of said rod, wherein said stopper plate of said container positioning member restricts migration of said container within said packaging bag during a deaeration operation by said deaeration nozzle.

* * * * *

UNITED STATES PATENT AND TRADEMARK OFFICE

CERTIFICATE OF CORRECTION

PATENT NO. : 7,712,290 B2
APPLICATION NO. : 11/426741
DATED : May 11, 2010
INVENTOR(S) : S. Imao It is certified that error appears in the above-identified patent and that said Letters Patent is hereby corrected as shown below:

On the Title Page, Item (56), Other Publications, second line, of the printed patent, the first listing of "U.S. Appl. No. 11/426,665 to Imao" should read --U.S. Appl. No. 11/426,599 to Imao--

Signed and Sealed this
Fifteenth Day of March, 2011

David J. Kappos

David J. Kappos
*Director of the United States Patent and Trademark Office*